US009030399B2

(12) United States Patent
Tseng et al.

(10) Patent No.: US 9,030,399 B2
(45) Date of Patent: May 12, 2015

(54) GATE DRIVER STAGE OUTPUTTING MULTIPLE, PARTIALLY OVERLAPPING GATE-LINE SIGNALS TO A LIQUID CRYSTAL DISPLAY

(75) Inventors: Chien-Chang Tseng, Hsinchu (TW); Kuang-Hsiang Liu, Hsinchu (TW); Sheng-Chao Liu, Hsinchu (TW); Che-Chia Chang, Hsinchu (TW); Ling-Ying Chien, Hsinchu (TW)

(73) Assignee: AU Optronics Corporation, Hsinchu (TW)

( * ) Notice: Subject to any disclaimer, the term of this patent is extended or adjusted under 35 U.S.C. 154(b) by 250 days.

(21) Appl. No.: 13/403,434

(22) Filed: Feb. 23, 2012

(65) Prior Publication Data

US 2013/0222357 A1 Aug. 29, 2013

(51) Int. Cl.
*G09G 3/36* (2006.01)
*G09G 3/20* (2006.01)

(52) U.S. Cl.
CPC ..... *G09G 3/20* (2013.01); *G09G 3/3677* (2013.01); *G09G 2310/0218* (2013.01); *G09G 2310/0286* (2013.01)

(58) Field of Classification Search
CPC ..... G09G 2300/0408; G09G 3/3266; G09G 3/3674; G09G 3/3677; G09G 2310/0267; G09G 2310/0281; G09G 2310/0286; G11C 19/00; G11C 19/182; G11C 19/184; G11C 19/28; G11C 19/287
USPC ..... 345/205, 206, 92, 98–100, 103
See application file for complete search history.

(56) References Cited

U.S. PATENT DOCUMENTS

| | | | | |
|---|---|---|---|---|
| 2008/0111801 | A1 * | 5/2008 | Hsu | 345/204 |
| 2008/0266275 | A1 * | 10/2008 | Tsai et al. | 345/204 |
| 2009/0021502 | A1 | 1/2009 | Lee et al. | |
| 2009/0167668 | A1 * | 7/2009 | Kim | 345/100 |
| 2010/0085294 | A1 * | 4/2010 | Otose | 345/100 |
| 2011/0142191 | A1 * | 6/2011 | Tobita et al. | 377/64 |
| 2011/0148830 | A1 * | 6/2011 | Hsu et al. | 345/205 |
| 2011/0182399 | A1 * | 7/2011 | Tobita | 377/70 |
| 2011/0273417 | A1 * | 11/2011 | Shin et al. | 345/211 |
| 2013/0033468 | A1 * | 2/2013 | Takahashi | 345/204 |
| 2013/0100007 | A1 * | 4/2013 | Yamamoto et al. | 345/100 |

FOREIGN PATENT DOCUMENTS

| | | | | |
|---|---|---|---|---|
| WO | WO 2011/148658 A1 * | 1/2011 | | G09G 3/36 |
| WO | 2011148658 | 12/2011 | | |

OTHER PUBLICATIONS

Japanese Office Action dated Jan. 28, 2014, issued in Japanese patent application 2013-012002 (3 pages).

* cited by examiner

*Primary Examiner* — Chanh Nguyen
*Assistant Examiner* — Navin Lingaraju

(57) ABSTRACT

A gate driver for driving a TFT-LCD panel includes a number of gate-driver circuits arranged in groups and stages. Each gate-driver circuit has a main driver and an output section. The main driver is used to provide a charging signal to the output section which has two or more output circuits. Each of the output circuits is configured to provide a gate-line signal in response to the charging signal and a clock signal. The gate-driver circuit uses fewer switching elements, such as thin-film transistors, than the conventional circuit. When the gate driver is integrated in a TFT-LCD display panel and disposed within the periphery area around the display area, it is desirable to reduce or minimize the number of switching elements in the gate driver so that the periphery area can be reduced.

7 Claims, 30 Drawing Sheets

GATE DRIVER STAGE OUTPUTTING MULTIPLE, PARTIALLY OVERLAPPING GATE-LINE SIGNALS TO A LIQUID CRYSTAL DISPLAY

FIELD OF THE INVENTION

The present invention relates generally to a driver circuit for an LCD display and, more particularly, to a gate driver-on-array (GOA) structure integrated in a display panel.

BACKGROUND OF THE INVENTION

A thin-film transistor liquid crystal display (TFT LCD) generally includes an LCD panel and a backlight unit for illumination. To simplify the process of making display panels including the LCD panel, a gate driver circuit for driving the display panel is integrated in the display panel and disposed within the periphery circuit area of the display panel. The gate driver circuit so integrated is known as a gate driver-on-array (GOA) structure. FIG. 1 shows a general layout of a display panel having a GOA structure. Since the GOA structure is fabricated on the display panel, it will take up some of the area of the display panel. That may increase the periphery area of the display panel. It is desirable to provide a gate driver-on-array that does not require a large periphery area of the display panel.

SUMMARY OF THE INVENTION

The present invention provides a gate driver for driving a display panel, such as a thin-film liquid crystal display (TFT-LCD) panel. The gate driver has a number of gate-driver groups for providing gate line signals to the liquid crystal display. Each of the gate-driver groups has a number of gate-driver stages. Each of the gate-driver stages has a number of gate-driver circuits. Each gate-driver circuit comprises a main driver and an output section. The main driver is used to provide a charging signal to the output section which has two or more output circuits. Each of the output circuits is configured to provide a gate-line signal in response to the charging signal and a clock signal. The gate-driver circuit, according to various embodiment of the present invention, uses fewer switching elements, such as thin-film transistors, than the conventional circuit. When the gate driver is integrated in a TFT-LCD display panel and disposed within the periphery area around the display area, it is desirable to reduce or minimize the number of switching elements in the gate driver so that the periphery area can be reduced.

Thus, the first aspect of the present invention is a gate driver circuit which comprises a main driver configured to provide a charging signal in response to a trigger pulse; and an output section comprising a plurality of output circuits arranged to receive the charging signal, wherein each of said plurality of output circuits is configured to provide an output signal in response to the charging signal and a different clock signal, said plurality of output circuits comprising a first output circuit and a second output circuit, wherein the output signal provided in the first output circuit is in response to the charging signal and a first clock signal, and the output signal provided in the second output circuit is in response to the charging signal and a second clock signal subsequent to the first clock signal.

In one embodiment of the present invention, the main driver comprises:

a first switching element comprising an output end and a controlling end, the controlling end arranged to receive the trigger pulse and the output end arranged to provide the charging signal, the first switching element operable in a conducting state in response to the trigger pulse;

a second switching element comprising a first end electrically connected to the output end of the first switching element, a second end connected to a voltage source, and a controlling end arranged to receive a second pulse subsequent to the trigger pulse for resetting the charging signal, wherein the second switching element is operable in a conducting state in response to the second pulse so as to electrically connect the output end of the first switching element to the voltage source;

a third switching element comprising a first end, a second end connected to the voltage source, and a controlling end connected to the output end of the first switching element, wherein the first end is arranged to receive the first clock signal and wherein the third switching element is operable in a conducting state in response to the charging signal; and a fourth switching element comprising a first end connected to the output end of the first switching element, a second end connected to the voltage source, and a controlling end arranged to receive the first clock signal.

In one embodiment of the present invention, the main driver is further configured to provide a resetting signal in response to the second pulse.

In one embodiment of the present invention, each of said plurality of output circuits comprises a first switching circuit comprising an input end, an output end and a controlling end, the first switching circuit operable in a conducting state in response to the charging signal received in the controlling end, wherein the input end is arranged to receive the different clock signal and the output end is arranged to provide the output signal when the first switching circuit is operated in the conducting state; a second switching circuit comprising a first end, a second end and a controlling end, wherein the first end of the second switching circuit is electrically connected to the output end of the first switching circuit, the second end of the second switching circuit is electrically connected to a voltage source, and wherein the second switching circuit is operable in a conducting state in response to the resetting signal received in the controlling end of the second switching circuit so as to effectively connect the output end of the first switching circuit to the voltage source.

Furthermore, each of said plurality of output circuits also comprises:

a third switching circuit comprising a first end, a second end and a controlling end, wherein the first end of the third switching circuit is electrically connected to the output end of the first switching circuit, the second end of the third switching circuit is electrically connected to the voltage source, and wherein the third switching element is operable in a conducting state in response to an input signal in the controlling end of the third switching circuit, wherein the input signal is complementary to the different clock signal.

According to various embodiments of the present invention, the first clock signal and the second clock signal are partially overlapping in time.

The second aspect of the present invention is a gate driver, which comprises a plurality of gate-driver stages, each of the gate-driver stages comprising:

a main driver configured to provide a charging signal in response to a trigger pulse, and an output section comprising a plurality of output circuits arranged to receive the charging signal and a different clock signal, said plurality of output circuits comprising at least a first output circuit and a second output circuit, the first output circuit arranged to provide a first output signal in response to the charging signal and a first clock signal, the second output circuit arranged to provide a second output signal in response to the charging signal and a second clock signal subsequent to the first clock signal, wherein the first clock signal and the second clock signal are partially overlapping in time.

In one embodiment of the present invention, the output signal provided in the first output circuit is in response to the charging signal and a first clock signal, and the output signal provided in the second output circuit is in response to the charging signal and a second clock signal subsequent to the first clock signal.

In one embodiment of the present invention, the main driver comprises:

a first switching element comprising an output end and a controlling end, the controlling end arranged to receive the trigger pulse and the output end arranged to provide the charging signal, the first switching element operable in a conducting state in response to the trigger pulse;

a second switching element comprising a first end electrically connected to the output end of the first switching element, a second end connected to a voltage source, and a controlling end arranged to receive a second pulse subsequent to the trigger pulse for resetting the charging signal, wherein the second switching element is operable in a conducting state in response to the second pulse so as to electrically connect the output end of the first switching element to the voltage source;

a third switching element comprising a first end, a second end connected to the voltage source, and a controlling end connected to the output end of the first switching element, wherein the first end is arranged to receive the first clock signal and wherein the third switching element is operable in a conducting state in response to the charging signal; and a fourth switching element comprising a first end connected to the output end of the first switching element, a second end connected to the voltage source, and a controlling end arranged to receive the first clock signal.

In one embodiment of the present invention, the main driver is further configured to receive a second pulse subsequent to the trigger pulse for resetting the charging signal.

In another embodiment of the present invention, the main driver further comprises a main output circuit arranged to provide a main output signal in response to the charging signal and a clock signal, wherein said plurality of gate-driver stages comprises Q stages, each of the Q stages arranged to provide N sequential output signals, wherein said Q stages comprises a first stage and a second stage, said Q stages arranged in a cascade fashion such that the first output signal of the first stage and the first output signal of the second stage are shifted by N time units, and wherein the main output signal from the first stage is arranged to provide the trigger pulse to the main driver in the second stage, wherein Q and N are positive integers greater than 1.

In various embodiments of the present invention, each of said plurality of output circuits comprises:

a switching element operable in a conducting state in response to the charging signal, the switching element comprises an input end to receive the different clock signal and an output end to provide an output signal when the switching element is operated in the conducting state; and a discharging unit electrically connected to the output end of the switching element, the discharging unit arranged to receive an input signal complementary to the clock signal for resetting the output signal.

Furthermore, each of said plurality of output circuits comprises:

a first switching circuit comprising an input end, an output end and a controlling end, the first switching circuit operable in a conducting state in response to the charging signal received in the controlling end, wherein the input end is arranged to receive the different clock signal and the output end is arranged to provide the output signal when the first switching circuit is operated in the conducting state;

a second switching circuit comprising a first end, a second end and a controlling end, wherein the first end of the second switching circuit is electrically connected to the output end of the first switching circuit, and the second end of the second switching circuit is electrically connected to a voltage source, and wherein the second switching circuit is operable in a conducting state in response to the resetting signal received in the controlling end of the second switching circuit so as to effectively connect the output end of the first switching circuit (M7) to the voltage source; and a third switching circuit comprising a first end, a second end and a controlling end, wherein the first end of the third switching circuit is electrically connected to the output end of the first switching circuit, and the second end of the third switching circuit is electrically connected to the voltage source, and wherein the third switching element is operable in a conducting state in response to an input signal in the controlling end of the third switching circuit, wherein the input signal is complementary to the different clock signal.

The third aspect of the present invention is a method for driving a display panel, the display panel comprising a display area comprising a thin-film transistor array, the transistor array configured to receive gate lines signals in a plurality of gate lines for controlling an array of pixels. The method comprises:

providing a gate line driver to generate the gate line signals for driving the thin-film transistor array, the gate line driver comprising a plurality of gate-driver stages, each of the gate-driver stages comprising a main driver and an output section comprising a plurality of output circuits;

providing a trigger pulse to the main driver for generating a charging signal in response to the trigger signal;

providing a plurality of sequential clock signals to the output section;

providing the charging signal and a different one of the sequential clock signals to each of said plurality of output circuits for generating one of the gate line signals, wherein the plurality of sequential clock signals are arranged such that they are overlapping in time with one another.

In one embodiment of the present invention, the method further comprises:

arranging the gate line driver into Q gate-driver stages, each of the Q stages configured to provide N sequential output signals, said N sequential output signals comprising a first output signal and a last output signal subsequent to the first output signal, wherein said Q stages comprises a first stage and a last stage, said Q stages arranged in a cascade fashion such that the first output signal of the first stage and the last output signal of the last stage are shifted by $(Q \times N-1)$ time units, wherein Q and N are positive integers greater than 1.

In another embodiment of the present invention, the method further comprises: arranging the gate line driver into Q gate-driver stages, each of the Q stages arranged to provide N sequential output signals, said N sequential output signals comprising a first output signal and a last output signal subsequent to the first output signal, wherein said Q stages comprises a first stage and a second stage, said Q stages arranged in a cascade fashion such that the first output signal of the first stage and the first output signal of the second stage are shifted by N time units, and wherein one of said N sequential output signals from the first stage is arranged to provide the trigger pulse to the main driver in the second stage, wherein Q and N are positive integers greater than 1.

In a different embodiment, the method further comprises:

arranging the gate line driver into a plurality of gate-line groups, each group comprising P gate-lines, and said plurality of gate-driver stages comprises Q gate-driver stages for providing said P gate lines, and each of said Q gate-driver stages comprises R of said plurality of output circuits arranged to receive R sequential clock signals for providing R sequential output signals, P, Q and R being positive integers greater than 1, wherein said R clock signals comprises a first clock pulse and a second clock pulse immediately subsequent to the first clock pulse and wherein the first clock pulse and the second clock pulse are shifted by a time unit, and wherein the main driver is further configured to receive a reset pulse subsequent to the trigger pulse for resetting the charging signal, and wherein the trigger pulse and the reset pulse are shifted by P time units.

Furthermore, the first clock pulse is subsequent to the trigger pulse such that the trigger pulse and the first clock pulse are shifted by a time period determined by [(P/2)−R+1], wherein when [(P/2)−R+1] is equal to 1, the time period is equal to one time period, and when [(P/2)−R+1] is greater than 1, the time period is equal to M time period, with M being a positive integer from 1 up to [(P/2)−R+1].

In various embodiments of the present invention, the plurality of sequential clock signals comprise N sequential clock signals and said plurality of output circuits comprises N output circuits arranged to receive the N sequential clock signals for providing N sequential output signals, wherein said N clock signals comprises a first clock pulse and a second clock pulse immediately subsequent to the first clock pulse and wherein the first clock pulse and the second clock pulse are shifted by one time unit, and wherein the first clock pulse is subsequent to the trigger pulse such that the trigger pulse and the first clock pulse are shifted by at least one time unit, wherein N is a positive integer greater than 1.

In one embodiment of the present invention, the display area is arranged on a first section of a substrate, and the gate line driver is disposed on a second section of the substrate adjacent to the first section.

In another embodiment of the present invention, the display area is arranged on a first section of a substrate, the display area comprising a first side and a different second side, and wherein said plurality of gate lines comprises a first group of gate lines and a second group of gate lines. The method further comprises:

arranging said plurality of gate-drivers stages into a first group of gate-driver stages and a second group of gate-driver stages;

disposing the first group of gate-driver stages in a second section of the substrate adjacent to the first side of the display area to provide gate line signals in the first group of gate lines; and disposing the second group of gate-driver stages in a third section of the substrate adjacent to the second side of the display area to provide the gate line signals in the second group of gate lines.

The present invention will become apparent upon reading the description taken in conjunction with FIGS. 2 to 28.

DETAILED DESCRIPTION OF THE INVENTION

Figure 1:
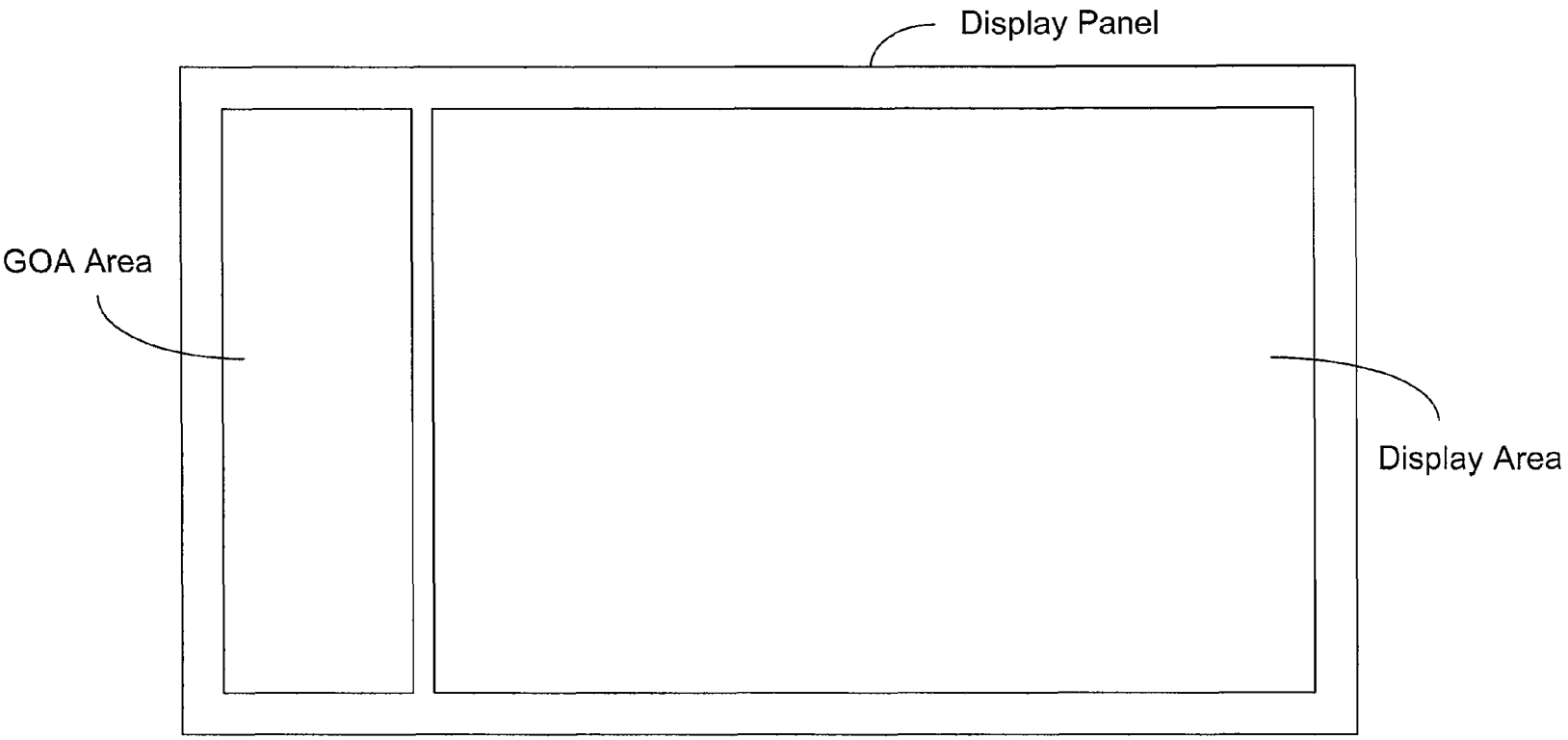
FIG. 1 (Prior Art)
FIG. 1 shows a prior art display panel having a gate driver-on-array area adjacent to a display area.
Figure 2:
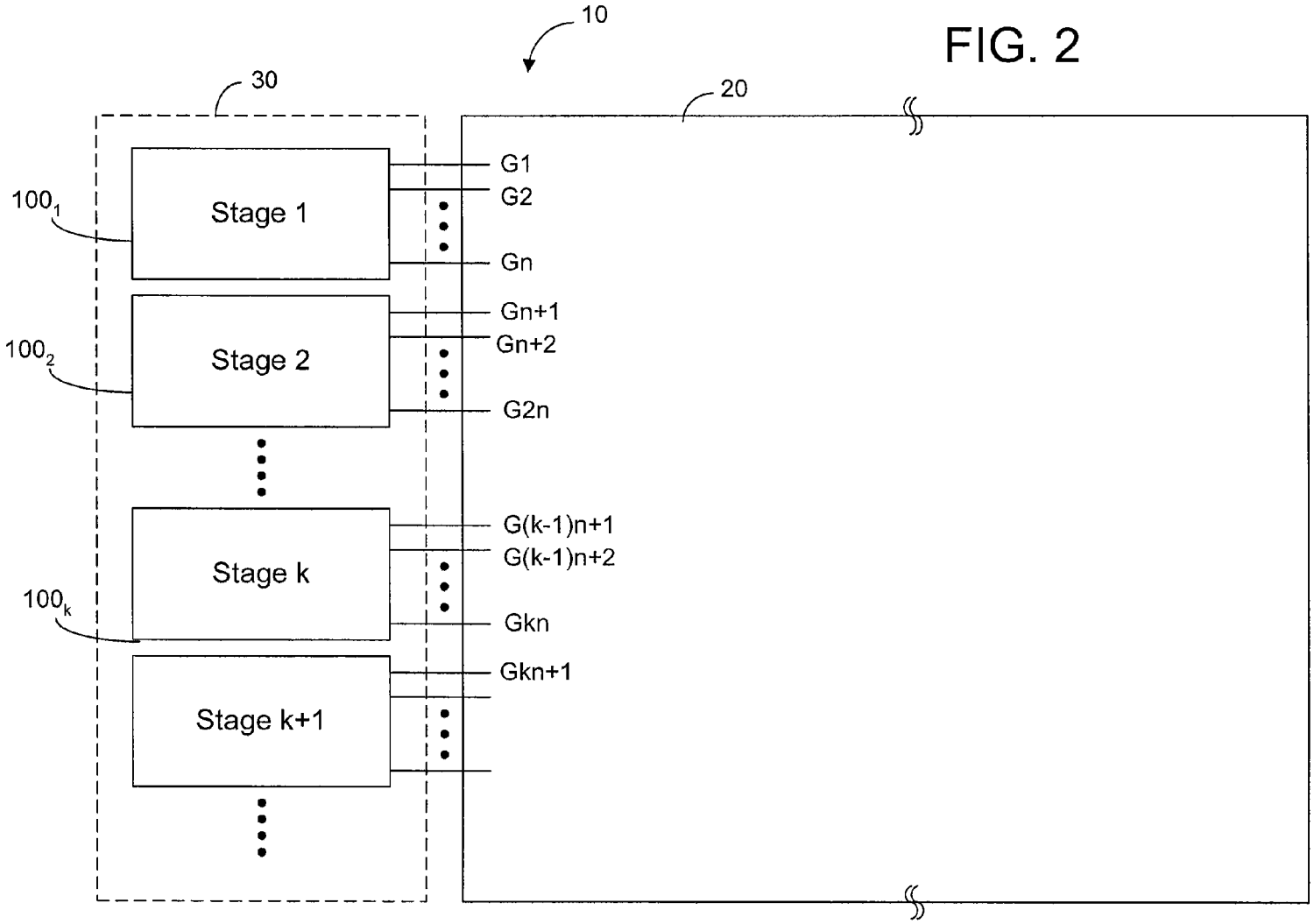
FIG. 2 shows a display panel, according to one embodiment of the present invention.
Figure 3:
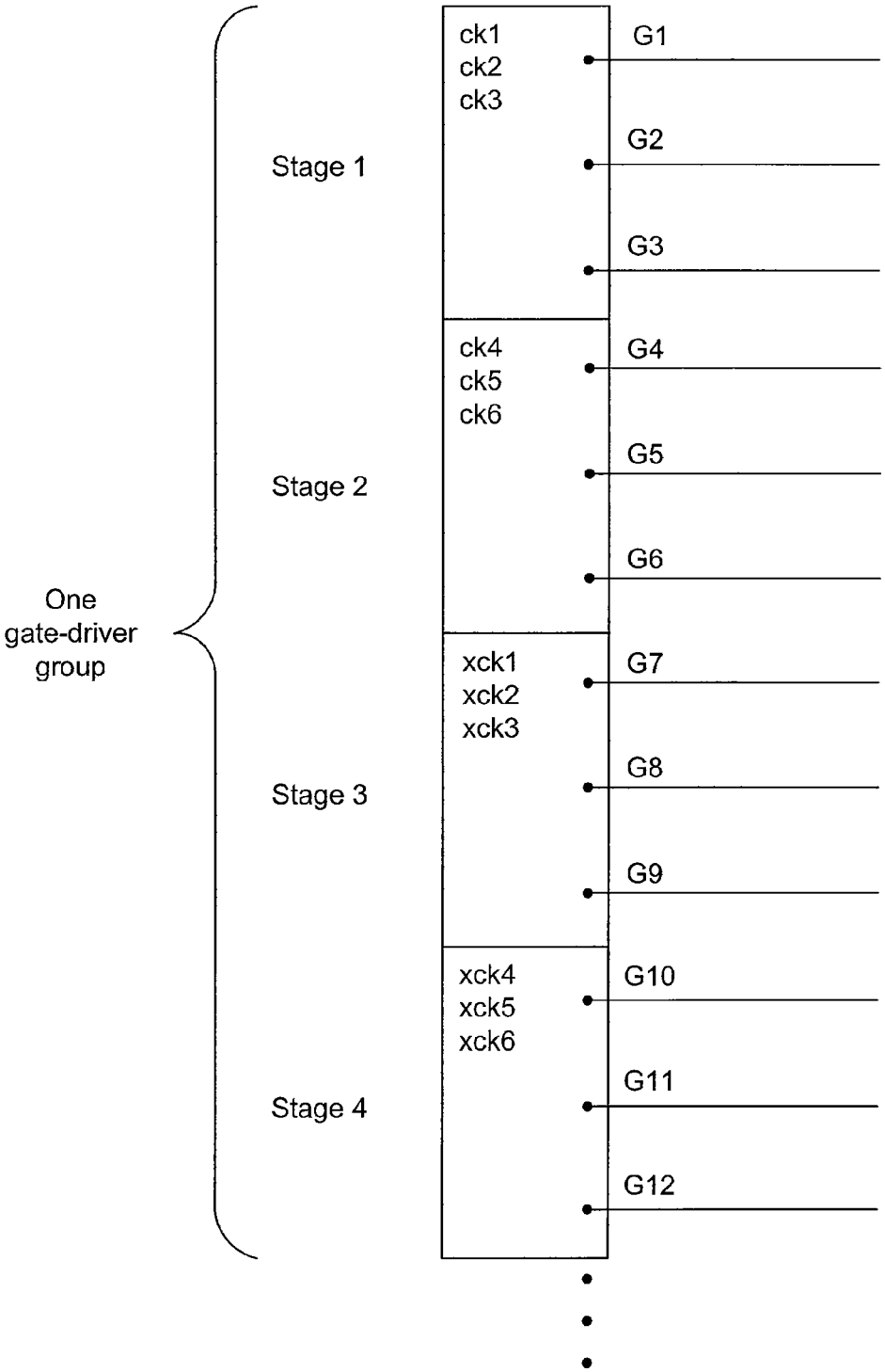
FIG. 3 shows a number of gate lines in a gate driver group, according to one embodiment of the present invention.
Figure 4:
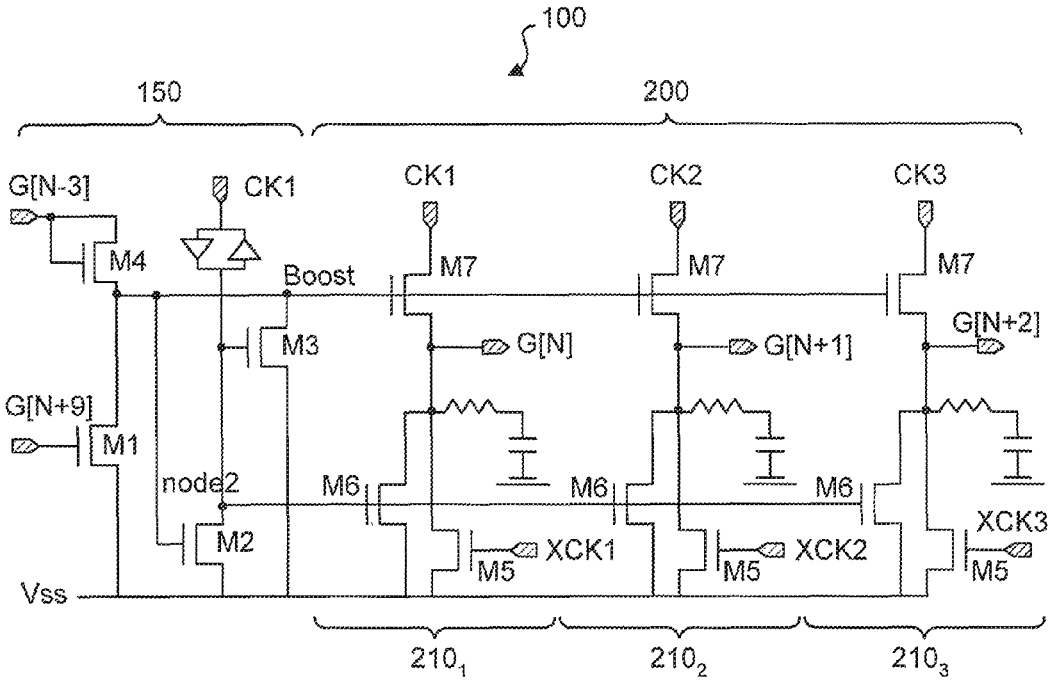
FIG. 4 shows a stage in a gate-driver group, according to one embodiment of the present invention.
Figure 6:
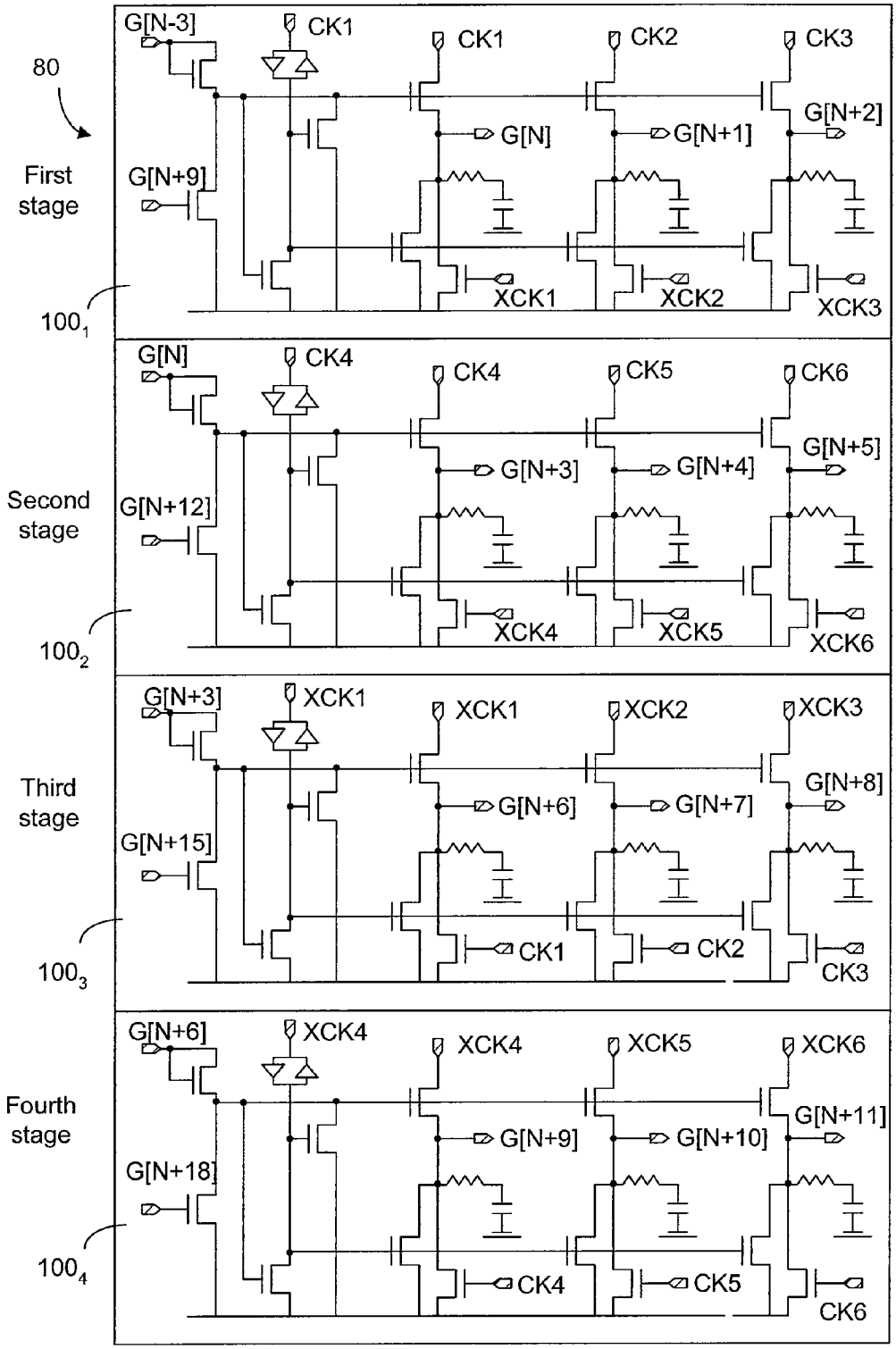
FIG. 6 shows four stages in a gate-driver group, according to one embodiment of the present invention.

It is known in the art that the image on a display panel, such as a LCD panel, is composed of a plurality of pixels arranged in a two-dimensional array of columns and rows or lines. Each line of pixels is activated or charged by a gate signal provided by the gate-line driver on a gate line. The time for charging a line of pixels is denoted by H. In a display panel where there are 1440 lines of pixels, there are 1440 gate lines denoted as G1, G2, . . . , G1440. The gate line signals are typically generated in a gate driver circuit in response to a plurality of clock signals ck1, ck2, . . . and complementary clock signals xck1, xck2, . . . As shown in FIG. 2, a display panel 10 comprises a display area 20 and a gate driver circuit 30. The gate driver circuit 30 provides the gate line signals to the display area 20 via a plurality of gate lines G1, G2, . . . . According to one embodiment of the present invention, the gate driver circuit 30 comprises a plurality of gate-driver stages $\mathbf{100}_1$, $\mathbf{100}_2$, . . . . Each of the gate-driver stage $\mathbf{100}_k$ provides n gate lines. The number of gate-driver stages in the gate-driver circuit 30 and the number of gate lines in each stage vary with different embodiments of the present invention. Furthermore, according to various embodiments of the present invention, the gate-driver stages are grouped into a plurality of gate-driver groups. The number of stages and the number of gate lines in each gate-driver group depend upon the embodiments. In the embodiment as shown in FIG. 6, a gate-driver group has four stages $\mathbf{100}_1$, $\mathbf{100}_2$, $\mathbf{100}_3$ and $\mathbf{100}_4$ and each of the stages provides gate line signals in three gate lines in response to six clock signals. FIG. 4 shows one of the stages in the gate driver group of FIG. 3, which shows the clock signals and gate lines in the four stages. As shown in FIG. 3, the first and second stages generate gate line signals in response to clock signals ck1, . . . ck6 while the third and fourth stages gate line signals in response to complementary clock signals xck1, . . . , xck6. Since the complementary clock signals xck1, . . . , xck6 are the same as ck7, . . . , ck14 in this case, the complementary clock signals are herein referred to as clock signals. In the embodiment as shown in FIGS. 3, 4 and 6, a gate-driver group is used to generate the gate line signals for twelve gate lines in four gate driver stages. Each of the gate driver stages has three gate lines.

Figure 9:
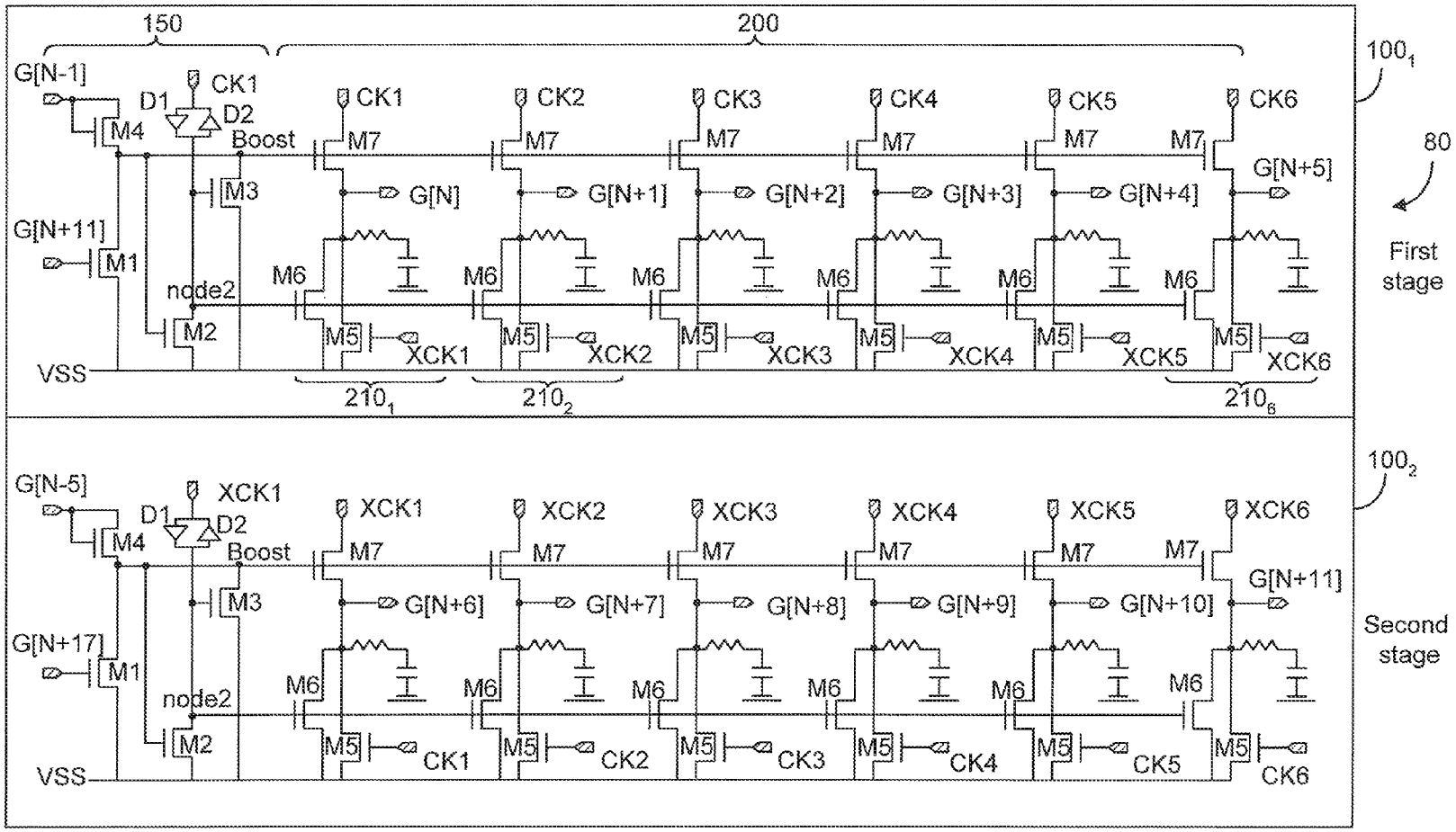
FIG. 9 shows two stages in a gate-driver group, according to a different embodiment of the present invention.
Figure 16:
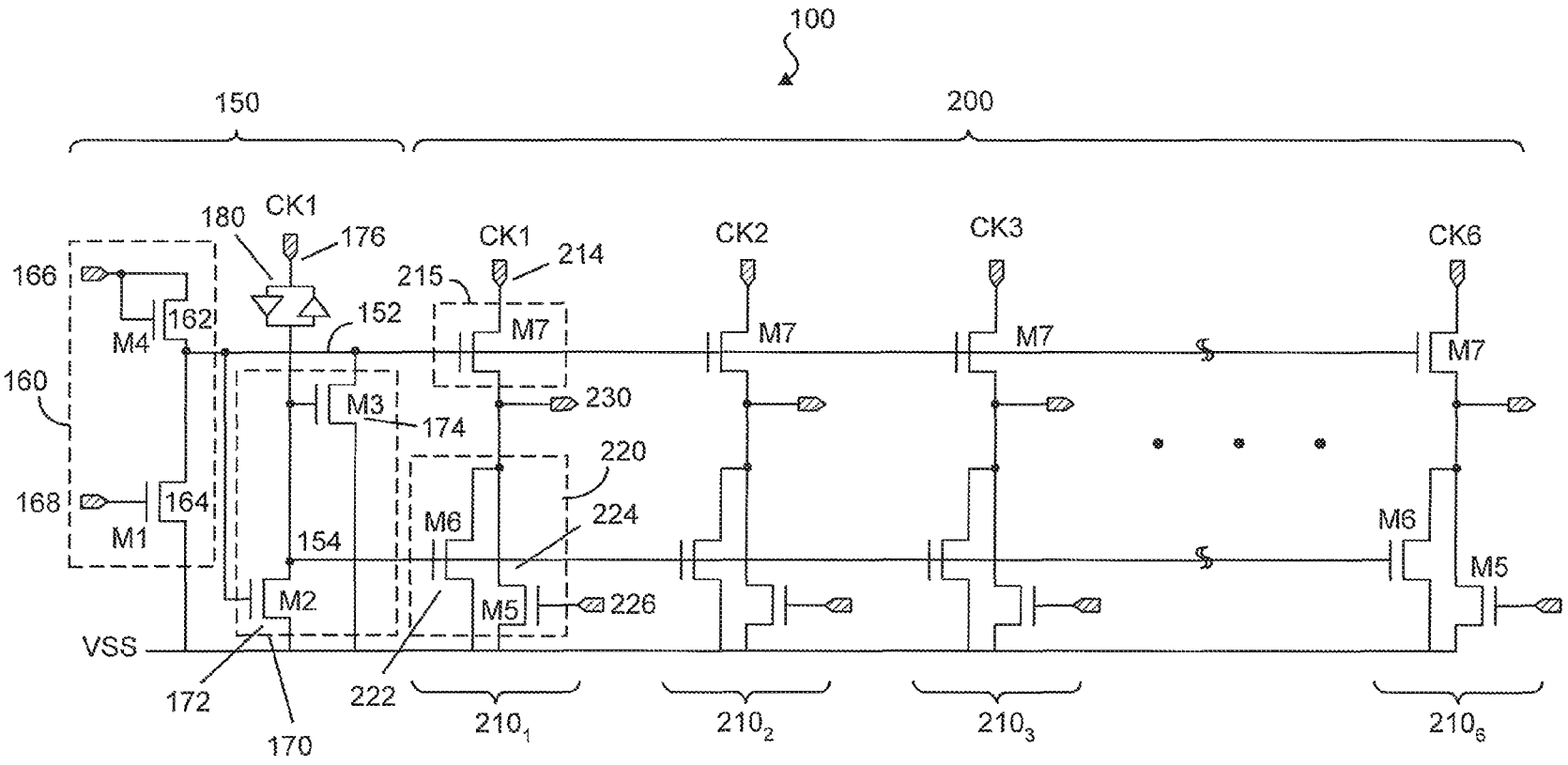
FIG. 16 shows the various circuits in a gate-driver stage.

FIG. 4 shows an exemplary gate-driver stage, according to one embodiment of the present invention. As shown in FIG. 4, the gate-driver stage 100 comprises two parts: a main driver 150 and a multi-output circuit 200. The multi-output circuit 200 comprises three sub-output circuits $\mathbf{210}_1$, $\mathbf{210}_2$, and $\mathbf{210}_3$ for providing three gate signals G[N], G[N+1] and G[N+2]. The multi-output circuit has six clock inputs to receive clock signals ck1, ck2, ck3, xck1, xck2 and xck3. The main driver 150 has three inputs to receive clock signal ck1 and gate line signals G[N−3], G[N+9]. The main driver 150 has two outputs denoted by "Boost" and "node2" for providing a charging signal pulse and a timing pulse. How the charging signal pulse and the timing pulse are used to generate the gate line signals will become apparent upon reading the description of the operational principle regarding the embodiment as shown in FIGS. 9 and 16.

Figure 5:
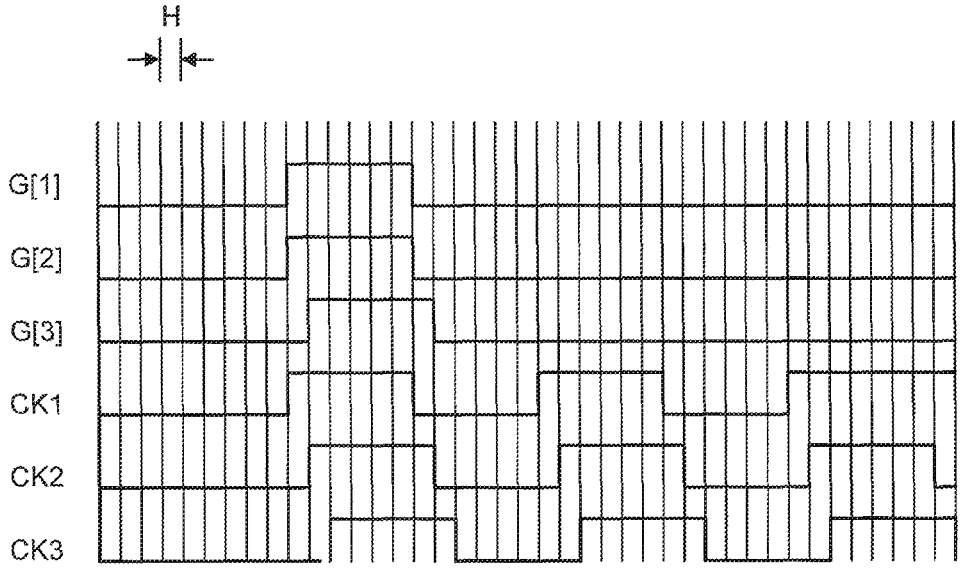
FIG. 5 is a time diagram showing the temporal relationship between the gate signals and the clock signals.

FIG. 5 is a timing diagram showing the temporal relationship between the gate line signals and the clock signals in the embodiment as shown in FIGS. 4 and 6. In particular, the gate-driver stage 100 as shown in FIG. 4 represents the first stage of the gate-driver group as shown in FIG. 6. As shown in FIG. 5, the pulse-width of the gate line signals and the clock signals is equal to 6 H, where H is the time for charging a line of pixels. The pulse-width in this embodiment is equal to PH/2 with P being the number of gate lines in the gate-driver group. As shown, the sequential clock signals ck1 and ck2 are shifted by 1 H. Similarly, the sequential gate line signals G[1] and G[2] are also shifted by 1 H, with G[1] being in synch with one of the ck1 clock signal pulses.

Figure 7:
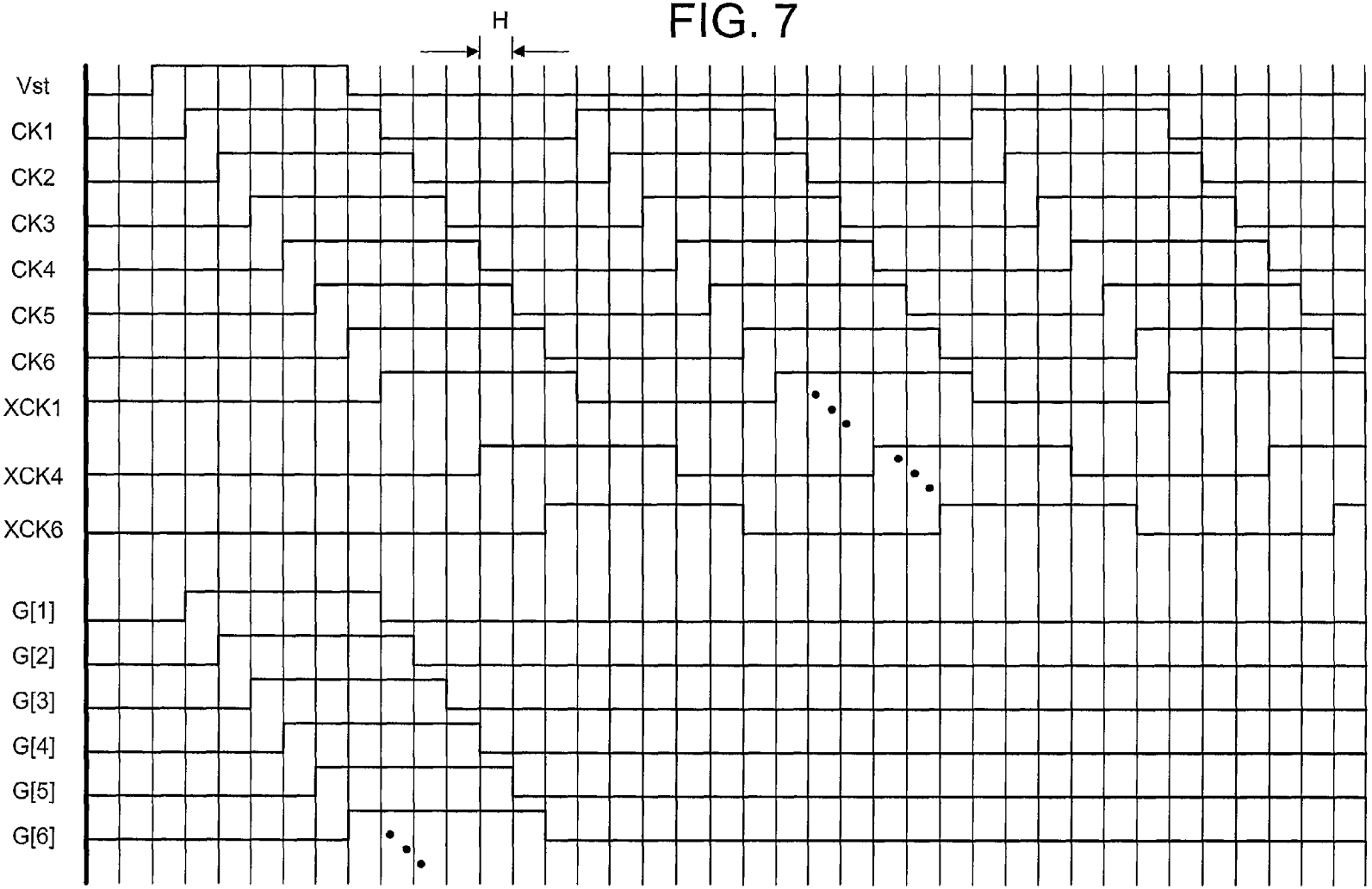
FIG. 7 is a timing diagram showing the temporal relationship between the gate signals and the clock signals according to the gate-driver group of FIG. 6.

FIG. 6 shows the four gate-driver stages in a gate-driver group 80 with twelve gate lines to provide twelve sequential gate line signals G[N] to G[N+11], in response to twelve clock signals ck1, ck2, . . . , ck6, xck1, xck2, . . . , xck6. As shown in FIG. 6, the gate-driver group 80 has four gate-driver stages $\mathbf{100}_1$, $\mathbf{100}_2$, $\mathbf{100}_3$ and $\mathbf{100}_4$. The first stage $\mathbf{100}_1$ generates gate line signals G[N] to G[N+2] in response to input clock signals ck1, ck2, ck3, xck1, xck2, xck3 and two input gate line signals G[N−3], G[N+9]. The second stage $\mathbf{100}_2$ generates gate line signals G[N+3] to G[N+5] in response to input clock signals ck4, ck5, ck6, xck4, xck5, xck6 and two input gate line signals G[N], G[N+12]. The third stage $\mathbf{100}_3$ generates gate line signals G[N+6] to G[N+8] in response to input clock signals xck1, xck2, xck3, ck1, ck2, ck3 and input gate line signals G[N+3], G[N+15]. The fourth stage $\mathbf{100}_4$ generates gate line signals G[N+9] to G[N+11] in response to input clock signals xck4, xck5, xck6, ck4, ck5, ck6 and input gate line signals G[N+6], G[N+18]. It should be noted that the choice for the input gate line signals various with embodiments and that the input gate line signal G[N−3] is originated from a previous gate-driver group, and the input gate-line signals G[N+12], G[N+18] are originated from a subsequent gate-driver group. The timing diagram of the twelve clock signals ck1, ck2, . . . , ck6, xck1, xck2, . . . , xck6 and gate line signals G[1], G[N2], . . . , G[1440] are shown in FIG. 7, along with a start pulse Vst and an end pulse Vend. The start pulse Vst is provided before the charging of the first line of pixels and the end pulse Vend is provided after the charging of the last line of the pixels in the display panel.

Figure 8:
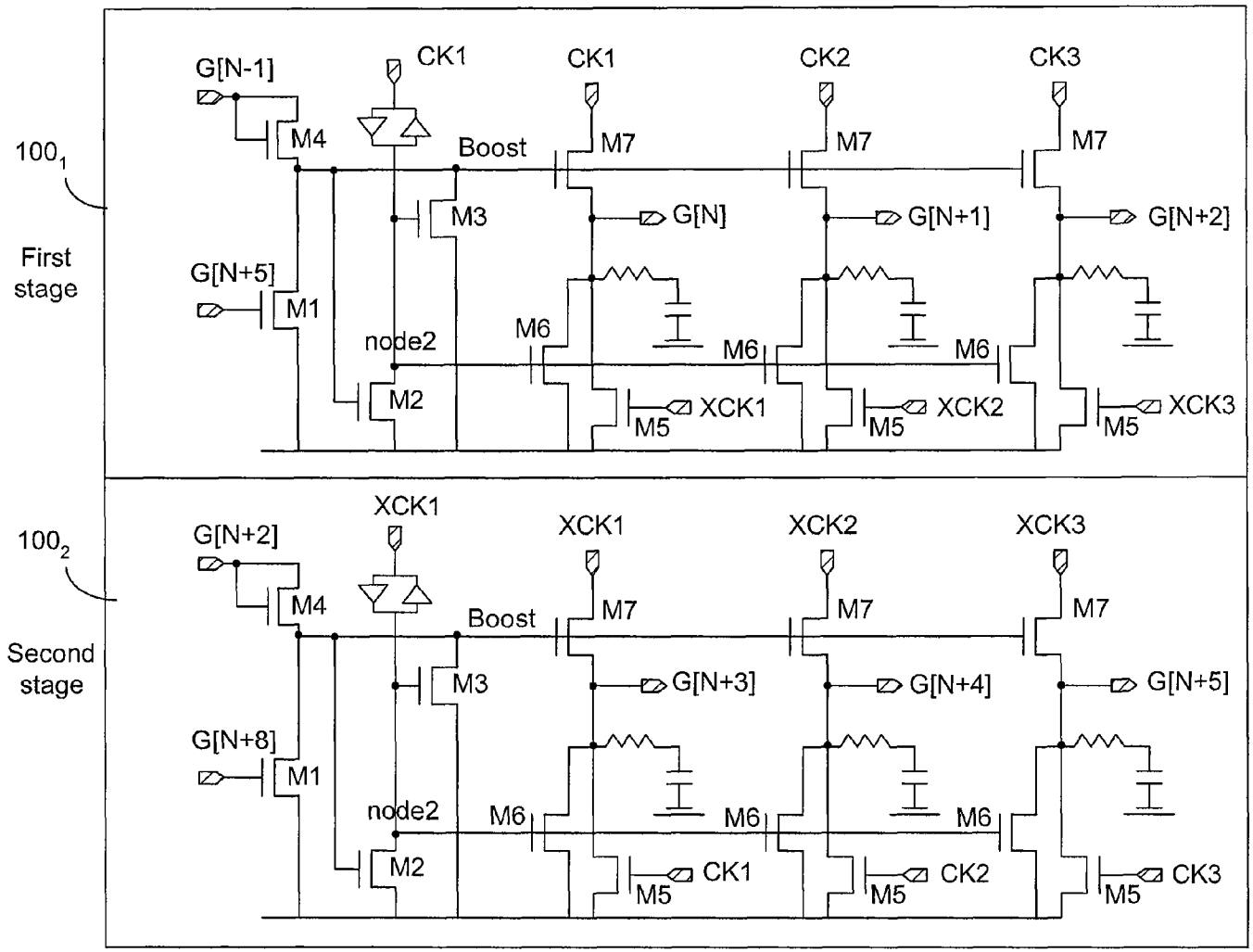
FIG. 8 shows two stages in a gate-driver group, according to another embodiment of the present invention.

FIG. 8 shows another embodiment of the present invention. In this embodiment, each gate-driver group has two gate-driver stages to generate six gate line signals G[N] to G[N+5], in response to six clock signals ck1, ck2, ck3, xck1, xck2, xck3. As shown in FIG. 8, the first stage generates gate line signals G[N] to G[N+2] in response to input clock signals ck1, ck2, ck3, xck1, xck2, xck3 and gate line signals G[N−1], G[N+5]. The second stage generates gate line signals G[N+3] to G[N+5] in response to input clock signals xck1, xck2, xck3, ck1, ck2, ck3 and gate line signals G[N+2], G[N+8].

FIG. 9 shows yet another embodiment of the present invention. In this embodiment, each gate-driver group has two gate-driver stages to generate twelve gate line signals G[N] to G[N+11], in response to twelve clock signals ck1, ck2, . . . , ck6, xck1, xck2, . . . , xck6. As shown in FIG. 8, the first stage generates gate line signals G[N] to G[N+5] in response to input clock signals ck1, ck2, . . . , ck6, xck1, xck2, . . . , xck6 and gate line signals G[N−1], G[N+11]. The second stage generates gate line signals G[N+6] to G[N+11] in response to input clock signals xck1, xck2, . . . , xck6, ck1, ck2, . . . , ck6 and gate line signals G[N+5], G[N+17].

Figure 10A:
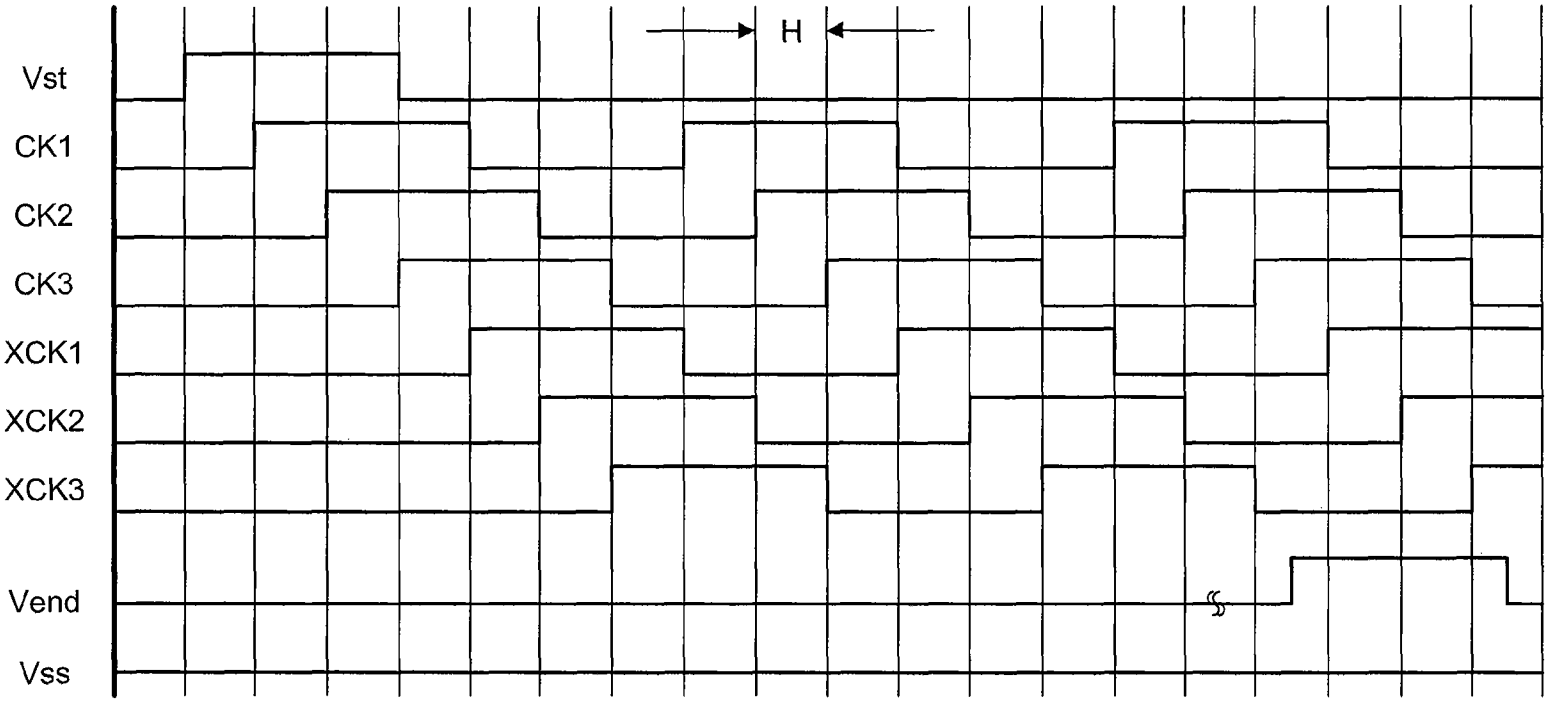
FIG. 10*a* is a timing diagram showing the temporal relationship between the gate signals and the clock signals according to the gate-driver group of FIG. 8.
Figure 10B:
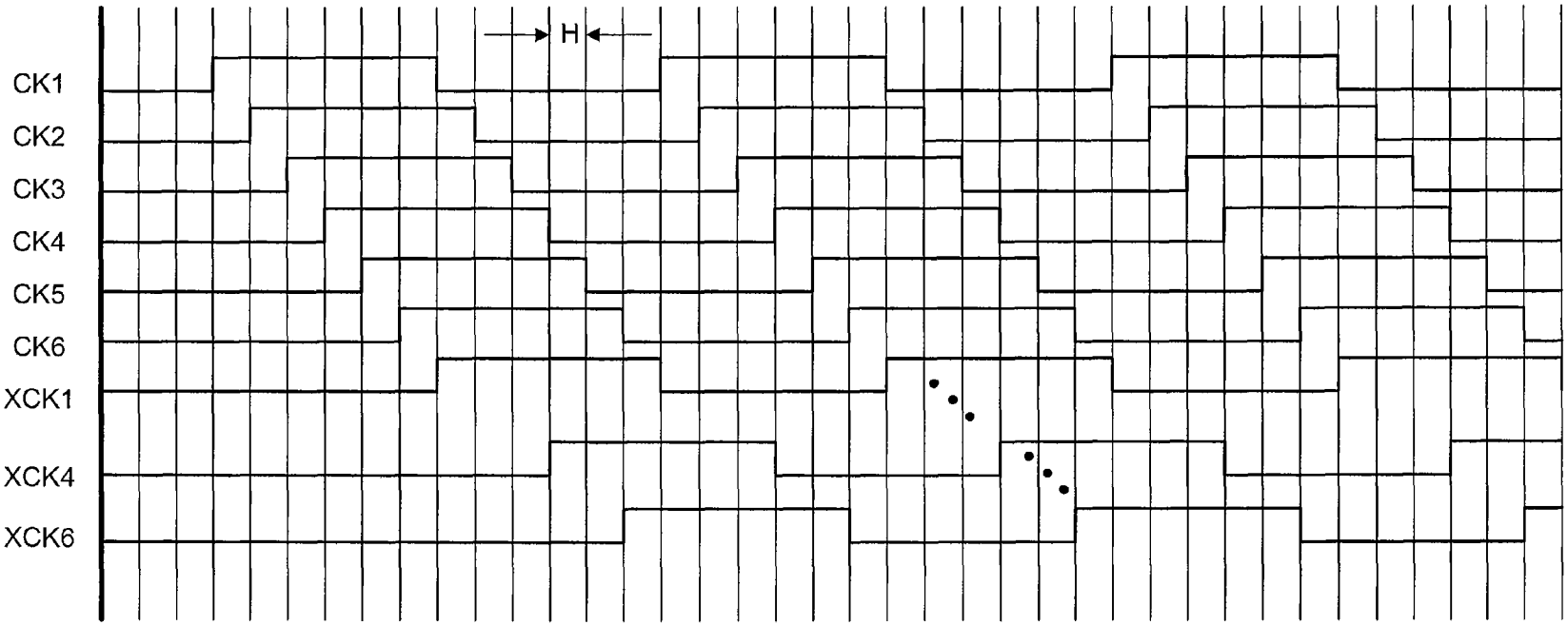
FIG. 10*b* is a timing diagram showing the temporal relationship between the gate signals and the clock signals according to the gate-driver group of FIG. 9.
Figure 11:
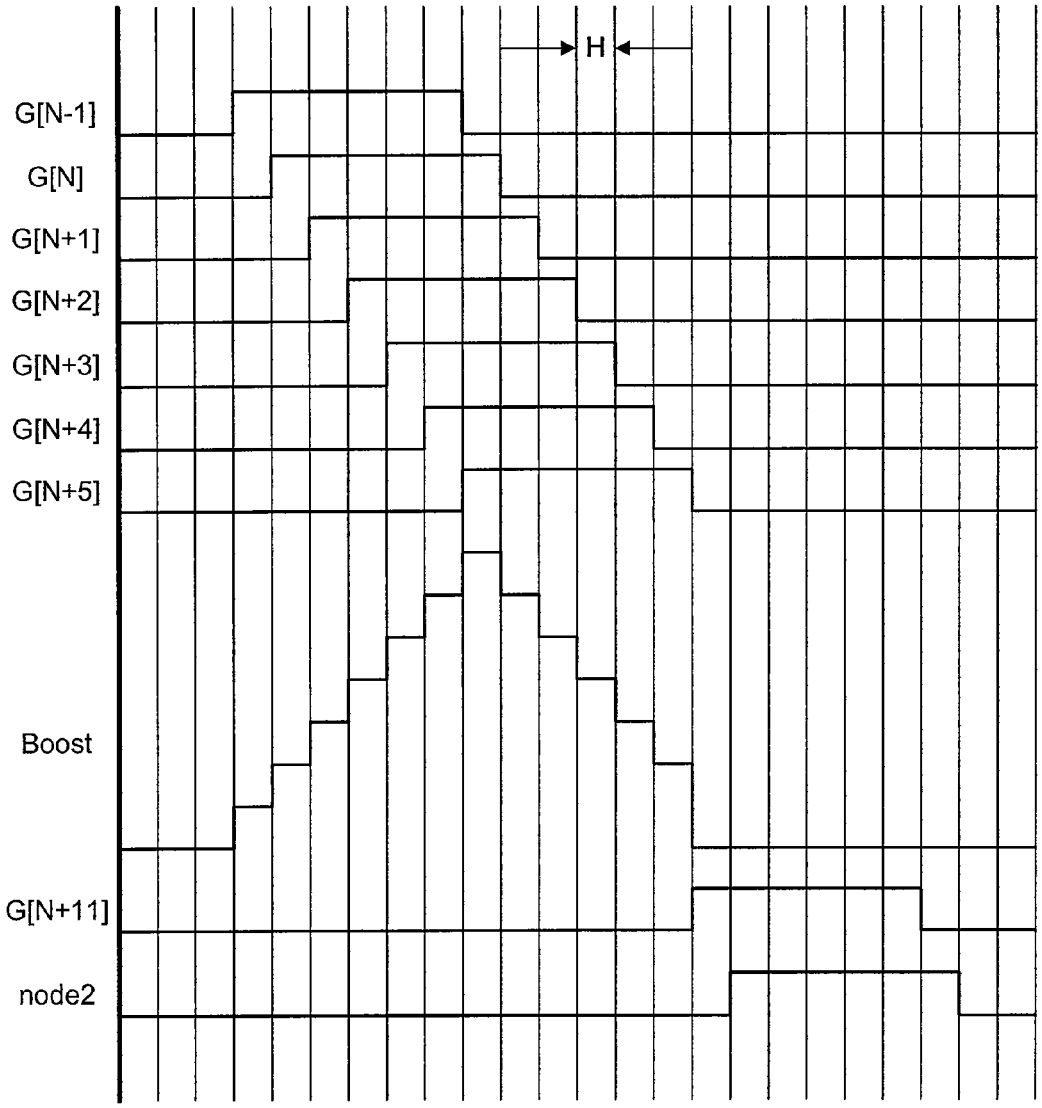
FIG. 11 is a more detailed timing diagram showing temporal relationship between the gate signals and various signal points in a driver stage according to the gate-driver group of FIG. 9.

FIG. 10*a* is a timing diagram showing the temporal relationship between the gate signals and the clock signals according to the gate-driver group of FIG. 8. FIG. 10*b* is a timing diagram showing the temporal relationship between the gate signals and the clock signals according to the gate-driver group of FIG. 9. In the embodiment as shown in FIG. 8, there are six gate lines, or P=6, in a gate-driver group. The pulse-width of clock signals ck1, ck2, and ck3 is 3 H and the time-shift between sequential clock signals in 1 H. In the embodiment as shown in FIG. 9, there are twelve gate lines, or P=12, in a gate-driver group. The pulse-width of clock signals ck1, ck2, . . . , ck6 is 6 H and the time-shift between sequential clock signals in 1 H. FIG. 11 is a more detailed timing diagram showing temporal relationship between the gate signals and various signal points in a driver stage according to the gate-driver group of FIG. 9.

FIG. 9 and FIG. 11 are now used to show the principle of the present invention. As with any gate-driver stage, the first stage $\mathbf{100}_1$ of the gate-driver group as shown in FIG. 9 comprises a main driver 150 and a multi-output circuit 200. In this embodiment, the multi-output circuit 200 comprises six sub-output circuits $\mathbf{210}_1$, $\mathbf{210}_2$, . . . , $\mathbf{210}_6$ for providing six gate signals G[N], G[N+1], . . . , G[N+5]. The multi-output circuit has twelve clock inputs to receive clock signals ck1, ck2, . . . , ck6, xck1, xck2, . . . , xck6. The main driver 150 has three inputs to receive clock signal ck1 and gate line signals G[N−1], G[N+11]. The main driver 150 has two outputs denoted by "Boost" and "node2" for providing a charging signal pulse and a timing pulse. The main driver 150 comprises four switching units M1 to M4 and optional diodes D1 and D2 to regulate the input clock signal ck1. Each of the sub-output circuits comprises three switching units M5, M6 and M7.

In the main driver 150, the switching unit M4 and M1 form an input unit. M4 is electrically connected to an input gate line signal G[N−1] for starting the charging process to the "Boost" signal (see FIG. 11). M1 is electrically connected to another input gate-line signal G[N+11] for discharging the "Boost" signal. The switching units M2 and M3 form a discharging unit. M2 is electrically connected to the "Boost" signal. As soon as the Boost signal level is charged, M2 is in a conducting state which pulls down the node2 level to the voltage level Vss, and M3 is in a non-conducting state which allows the Boost signal to be different from Vss. M3 is electrically connected to ck1 so as to reduce the "Boost" signal after the ck1 signal has passed. When the Boost signal is low and the ck1 signal is high, the node2 level is high. The input gate-line signal G[N−1] also serves as a trigger pulse for starting the generation of the gate line signals G[N] to G[N+5] in response to ck1 to ck6. Before the trigger pulse G[N−1], the Boost signal is pulled down to the voltage level Vss. Between the trigger pulse G[N−1] and the clock signal ck1, the Boost signal level is pre-charged for the time period of 1 H.

In each of the sub-output circuits $\mathbf{210}_1$, $\mathbf{210}_2$, . . . , $\mathbf{210}_6$, the switching unit M7 is in a conducting state as soon as the Boost signal level is pre-charged and serves as a pull-up unit for starting a gate line signal in response to the clock signal. Thus, each of the gate signals G[N], G[N+1], . . . , G[N+5] are sequentially generated in response to the sequential clock signals ck1, ck2, . . . , ck6. The clock signals ck1, ck2, . . . , ck6 sequentially increases the Boost signal level as shown in FIG. 11. The switching unit M5 serves as a pull-down unit for ensuring that the gate line signal is pulled down to Vss in response to the xck1 to xck6. Furthermore, when the switching unit M6 is in the conducting state, it also pulled down to gate line signal to Vss. Each of the gate line signals G[N] to G[N+5] is generated in response to the respective clock signals ck1 to ck6 after the trigger pulse G[N−1].

Figure 12:
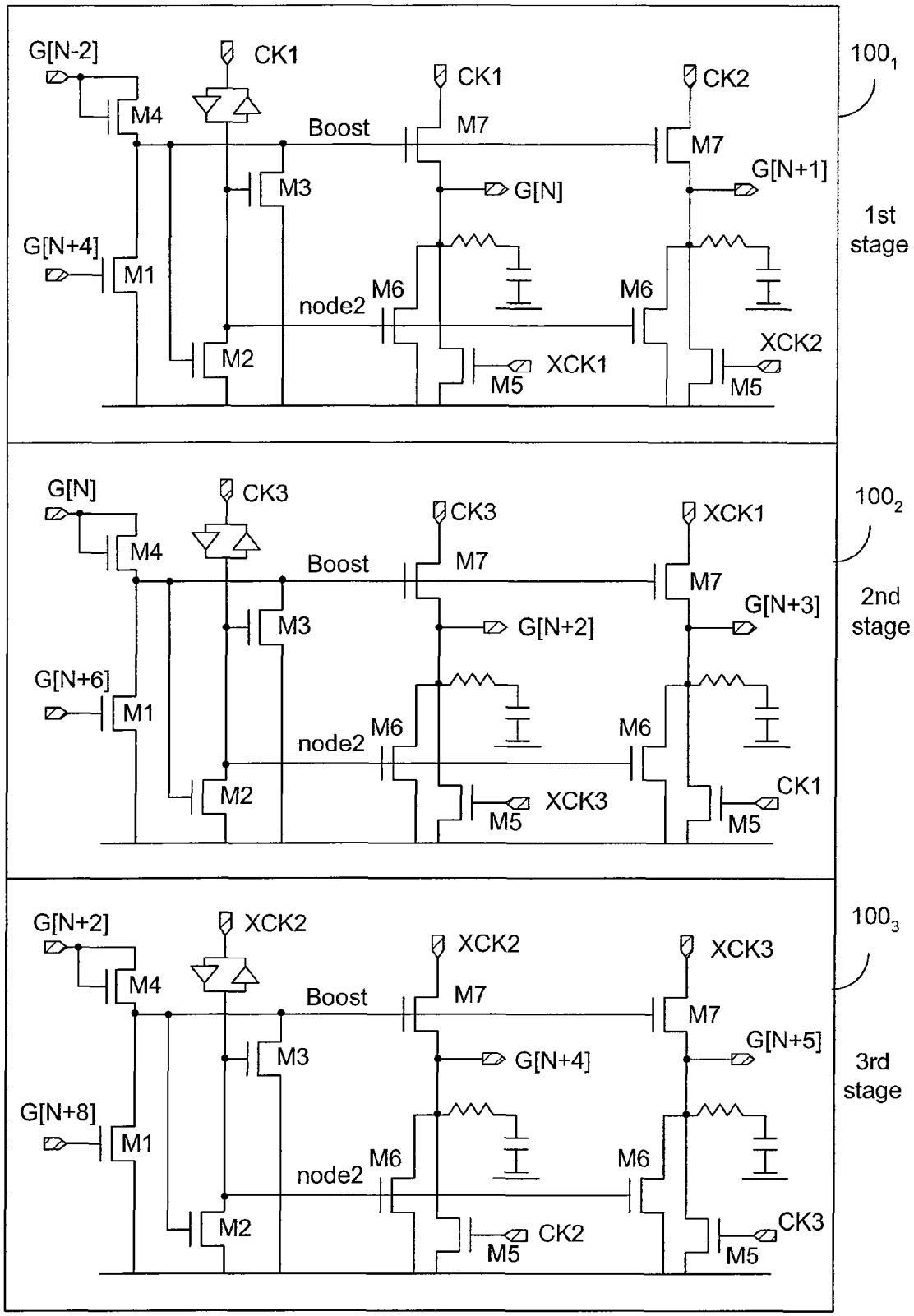
FIG. 12 shows three stages in a gate-driver group, according to one embodiment of the present invention.

FIG. 12 shows three gate-driver stages in a gate-driver group, according to one embodiment of the present invention. In each stage, two gate lines signals are generated on two gate lines in response to four clock signals. The number of gate lines on which the gate-line signals are provided by the gate-driver group is six.

Figure 13A:
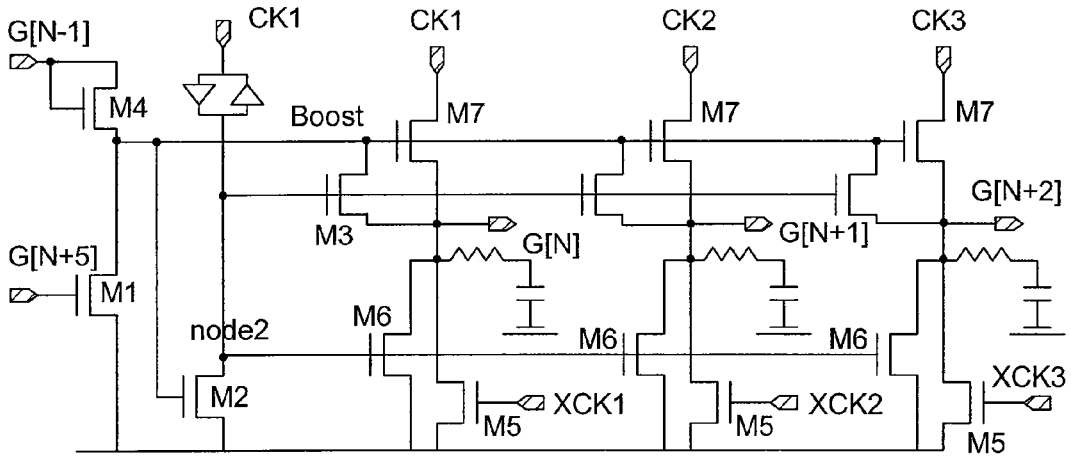
FIGS. 13*a*-13*c* show the stages in three gate-driver groups, according to three different embodiments of the present invention.
Figure 13B:
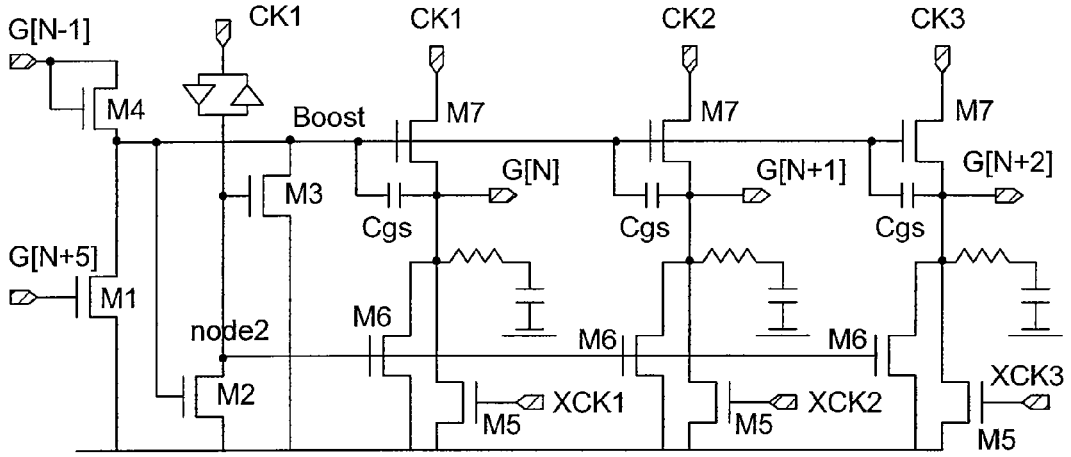
Figure 13C:
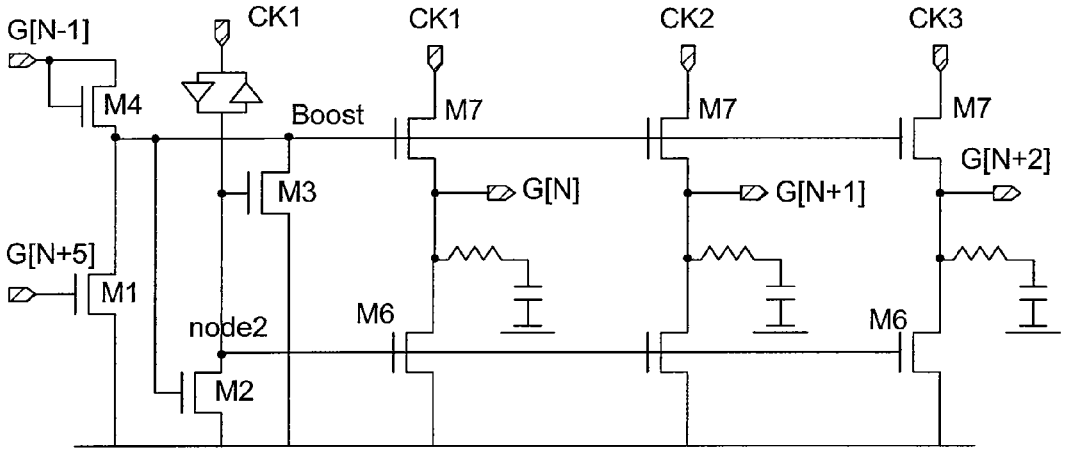

FIGS. 13*a*-13*c* shows three different gate-driver stages in a gate-driver group configured to provide gate line signals in twelve gate lines, as a variation to the gate-driver stage as shown in FIG. 4. In the embodiment as shown in FIG. 13*a*, the switching unit M3 is removed from the main driver 150. Each of the sub-output circuits has its own switching unit M3. In the embodiment as shown in FIG. 13*b*, the switching unit M5 is removed from each of the sub-output circuits. In the embodiment as shown in FIG. 13*b*, the switching units M7 that receive the clock signals ck2 and ck3 are replaced by a larger switching unit M8 and an even larger switching unit M9. In the embodiment as shown in FIG. 13*c*, a gate-source capacitor Cgs is provided to each of the switching units M7.

It should be noted that, in providing more than one gate line in each gate-driver stage, the number of TFT's to be used in the entire gate driver circuit 30 can be reduced. Consequently, the size of the GOA structure can be reduced.

Figure 14:
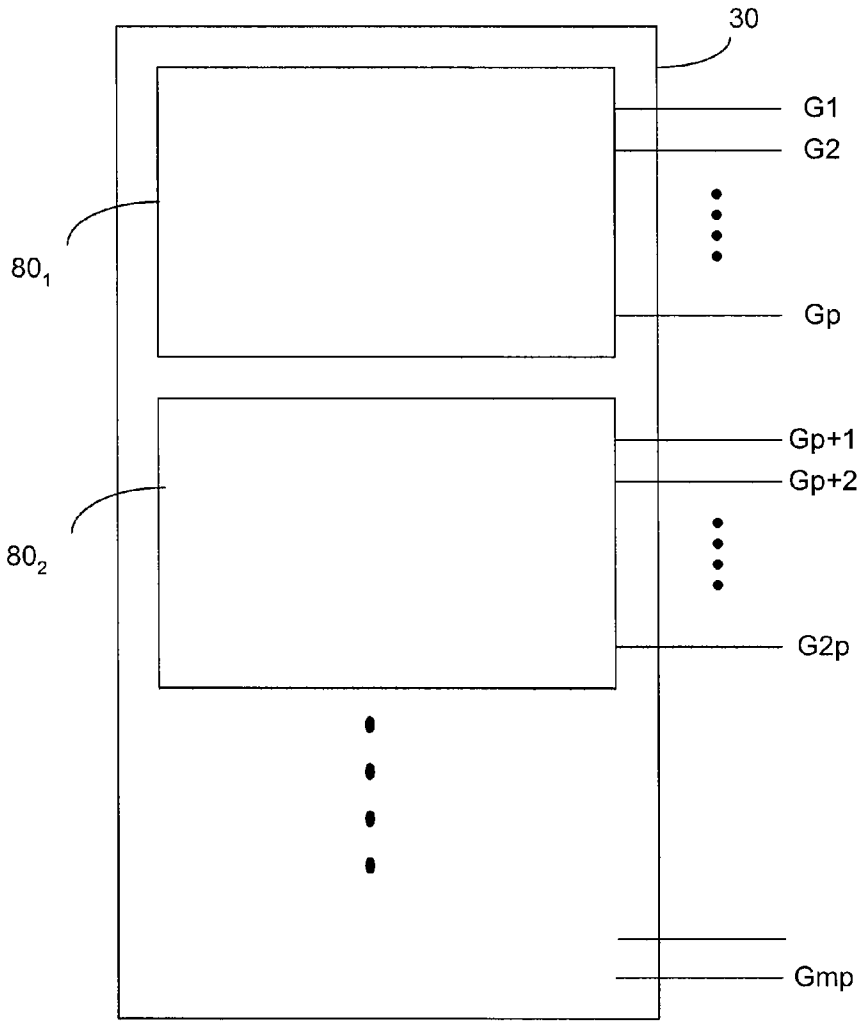
FIG. 14 shows how a gate-line driver is divided into gate-driver groups.
Figure 15:
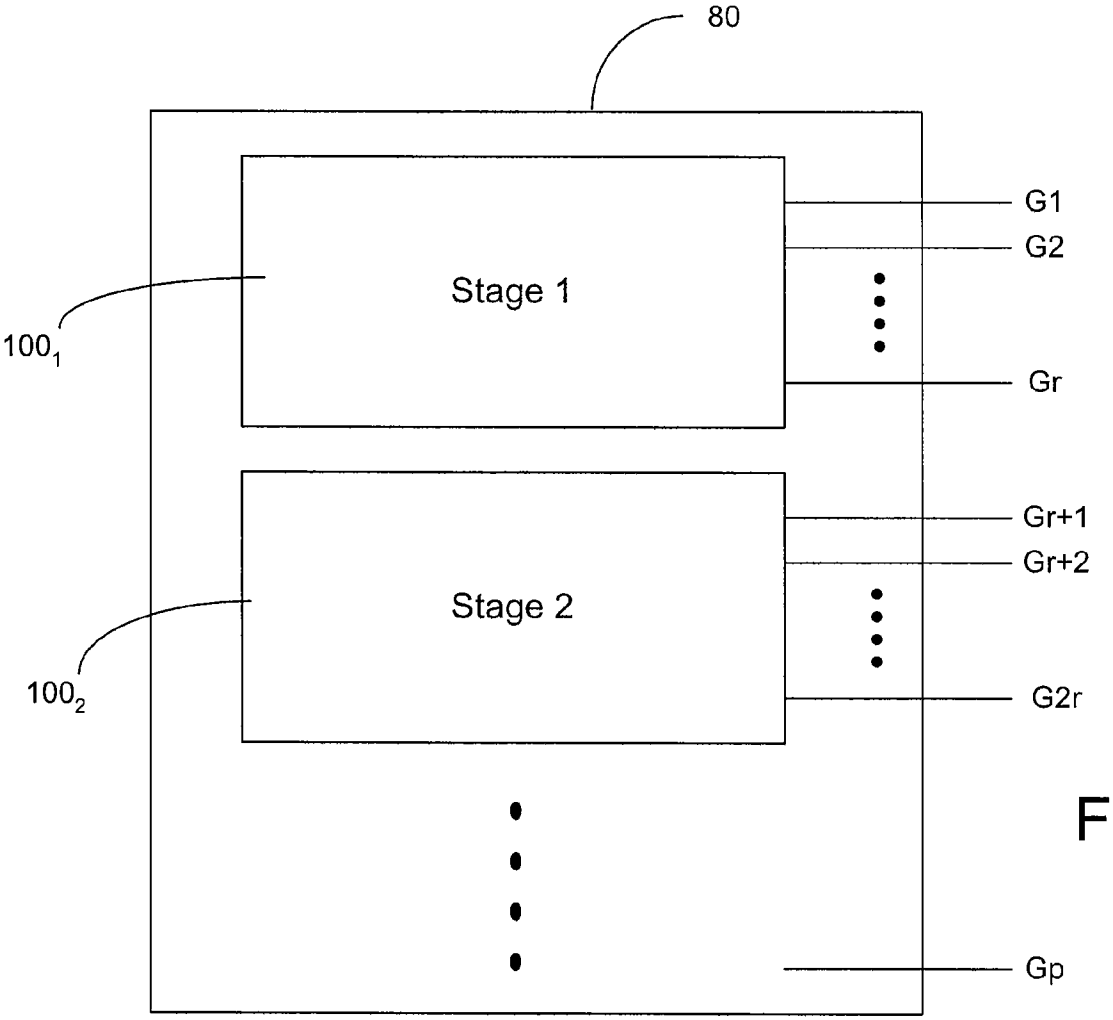
FIG. 15 shows how a gate-driver group is divided into gate-driver stages.

According to various embodiments, the present invention provides a gate-driver circuit that reduces the size of a GOA structure. As shown in FIG. 14, the gate driver circuit 30 comprises m gate-driver groups $\mathbf{80}_1$, $\mathbf{80}_2$, . . . with m being a positive integer greater than 1. Each gate-driver group is used to generate gate-line signals on P gate lines. As shown in FIG. 15, each gate-driver group 80 comprises Q gate-driver stages $\mathbf{100}_1$, $\mathbf{100}_2$, . . . , with Q being a positive integer greater than 1. Each gate-driver stage is used to generate gate line signals on R gate lines, with R being a positive integer greater than 1 such that P=Q×R. In the embodiment as shown in FIGS. 4, 6 and 13*a*-13*c*, P=12, Q=4 and R=3. In the embodiment as shown in FIGS. 8, P=6, Q=2 and R=3. In the embodiment as shown in FIGS. 9, P=12, Q=2 and R=6. In the embodiment as shown in FIGS. 12, P=6, Q=3 and R=2.

As shown in FIG. 16, a gate-driver stage 100 comprises a main driver 150 and multi-output circuit 200. The multi-output circuit 200 comprises a plurality of sub-output circuits $\mathbf{210}_1$, $\mathbf{210}_2$, . . . The main driver 150 comprises an input unit 160 to receive two input signals at the first signal input 166 and the second signal input 168. The input unit 160 comprises a first switching unit 162 electrically connected to the first signal input 166, and a second switching unit 164 electrically connected to the second signal input 168 and a reference voltage level Vss. The first switching unit 162 is connected to the second switching unit 164 to provide a "Boost" signal 152. The main driver 150 further comprises a discharging unit 170 having a signal input 176 for receiving a clock signal. The discharging unit 170 comprises a third switching unit 172 electrically connected to the "Boost" or charging signal 152 and the reference voltage level Vss for providing a "node2" signal or timing pulse 154. The switching unit 172 is configured to receive the clock signal from the signal input 176 through an optional stabilizing element 180 in order to condition the timing pulse 154. The discharging unit 170 may comprise a fourth switching unit 174 electrically connected to the timing pulse 154 and the reference voltage level Vss. The switching unit 174 is electrically connected to the charging signal 152 to control the charge level of the charging pulse 152.

Each of the sub-output circuits 210 comprises a pull-up unit 215 and a pull-down unit 220. The pull-up unit 215 comprises a fifth switching unit 212 electrically connected to the charging signal 152 and a clock signal at a clock input 214 for providing a gate line signal at output 230. The pull-down unit 220 comprises a sixth switching unit 222 electrically connected to the timing signal 154 and the reference voltage level Vss for pulling down the gate line signal at output 230. The pull-down unit 220 may comprise seventh switching unit 224 electrically connected to the reference voltage level Vss and a clock signal input 226 to receive a complementary clock signal for conditioning the gate line signal at output 230.

In the first stage $\mathbf{100}_1$ as shown in FIG. 6, the first gate signal is G[N] and the input gate-line signal to the switching unit M4 is G[N−3]. In the first stage $\mathbf{100}_1$ as shown in FIGS. 8 and 9, the first gate signal is G[N] and the input gate-line signal to the switching unit M4 is G[N−1]. In the first stage $100_1$ as shown in FIG. 12, the first gate signal is G[N] and the input gate-line signal to the switching unit M4 is G[N−2]. The selection of the input gate-line signal is determined by the pre-charged amount in the Boost signal level. As shown in FIG. 11, the Boost signal level is pre-charged for a period of 1 H before the generation of G[N]. Because the gate signal G[N−1] precedes by G[N] by 1 H, the gate signal G[N−1] can be used as a trigger pulse to the first stage $100_1$. In general, the pre-charging period can be determined by [(P/2)−R+1]×H. In the embodiment as shown in FIG. 8, we have P=6, R=3, and pre-charging period is 1 H. In the embodiment as shown in FIG. 9, P=12, R=6, and the pre-charging period is 1 H. In the embodiment as shown in FIG. 6, P=12, R=3, and the pre-charging period can be 4 H. It is possible to use one of gate signals G[N−4], G[N−3], G[N−2] and G[N−1] as a trigger pulse to the first stage $100_1$ so that the Boost signal level is pre-charged at least for 1 H period. In the embodiment as shown in FIG. 12, P=6, R=2, and the pre-charging period can be 2 H. It is possible to use one of gate signals G[N−2] and G[N−1] as a trigger pulse to the first stage $100_1$ so that the Boost signal level is pre-charged at least for 1 H period.

As for the gate signal to M1 for discharging the "Boost" signal, it is determined by the trigger pulse and the number, P, of gate lines in each gate-driver group. In FIG. 6, the trigger pulse to M4 is G[N−3] and P=12, and the gate signal to M1 is G[N+9]. In FIG. 8, the trigger pulse to M4 is G[N−1] and P=6, and the gate signal to M1 is G[N+5]. In FIG. 9, the trigger pulse to M4 is G[N−1] and P=12, and the gate signal to M1 is G[N+11]. In FIG. 12, the trigger pulse to M4 is G[N−2] and P=6, and the gate signal to M1 is G[N+4].

Figure 17B:
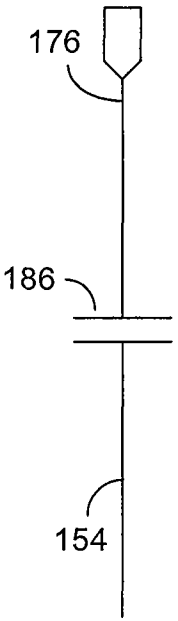
FIGS. 17*a* and 17*b* show different stabilization elements through which a signal input is received in the main driver.
Figure 17A:
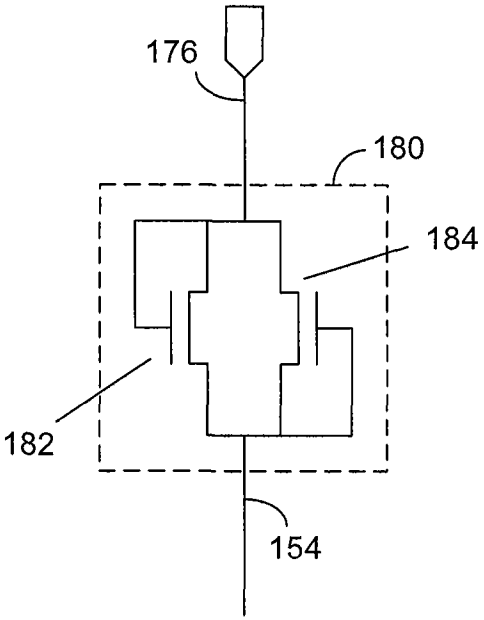

It should be noted that the stabilization element 180 as shown in FIG. 16 is optional. It can be formed from two switching units 182 and 184 as shown in FIG. 17*a*. It can also be replaced by a capacitor 186 as shown in FIG. 17*b*.

Figure 18A:
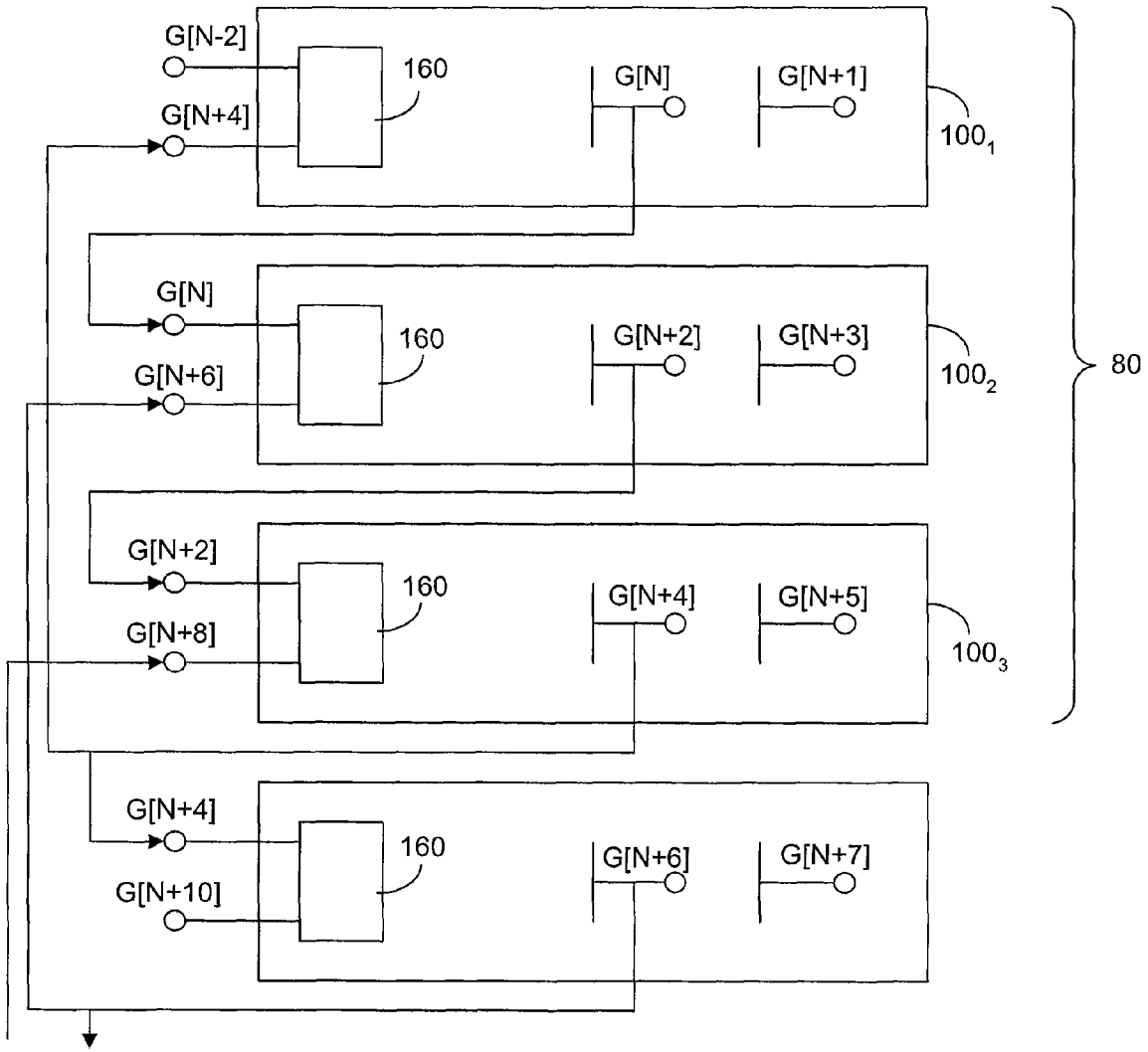
FIGS. 18*a*-18*d* show the connections between gate-driver states in various gate-driver circuits.
Figure 18B:
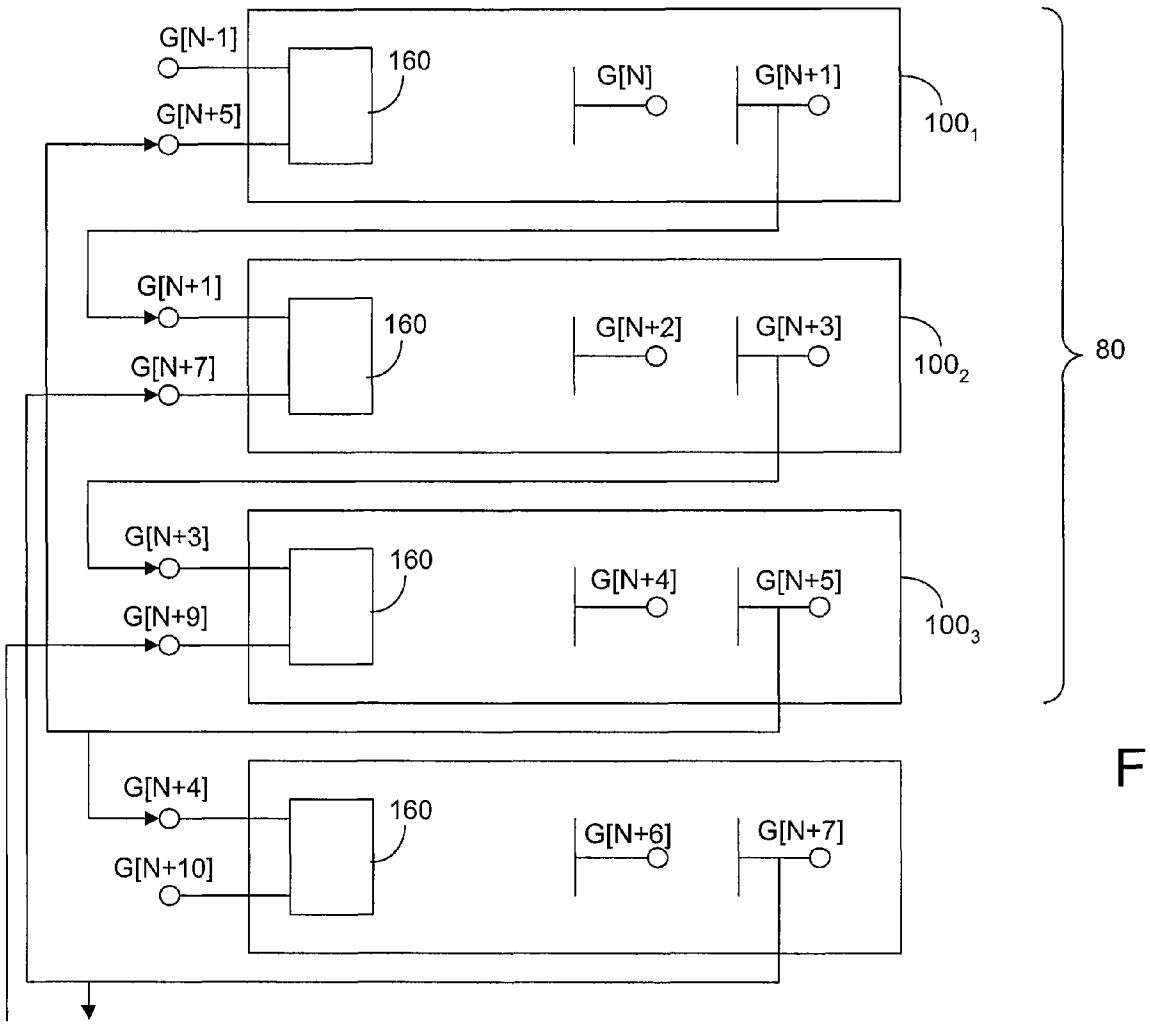
Figure 18C:
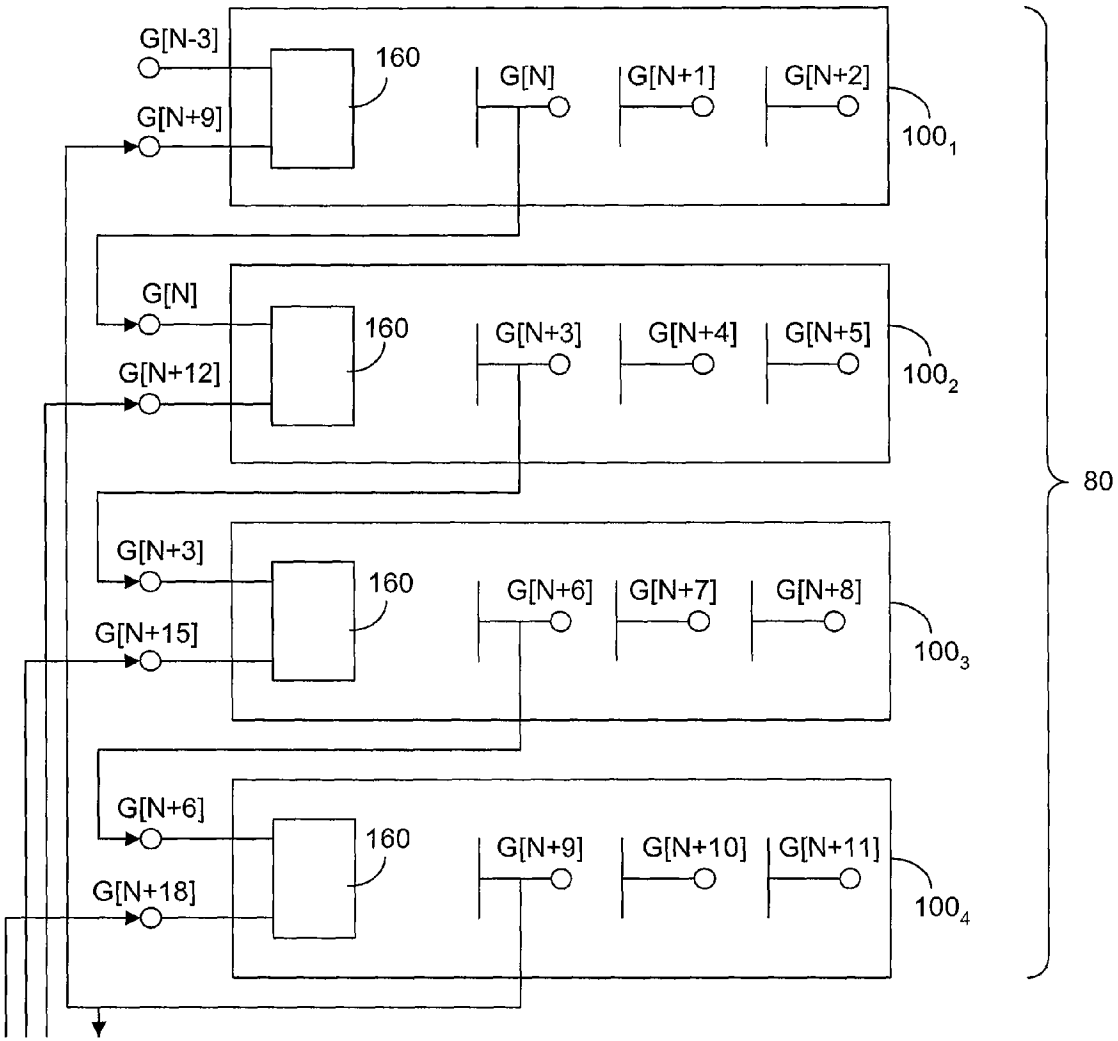
Figure 18D:
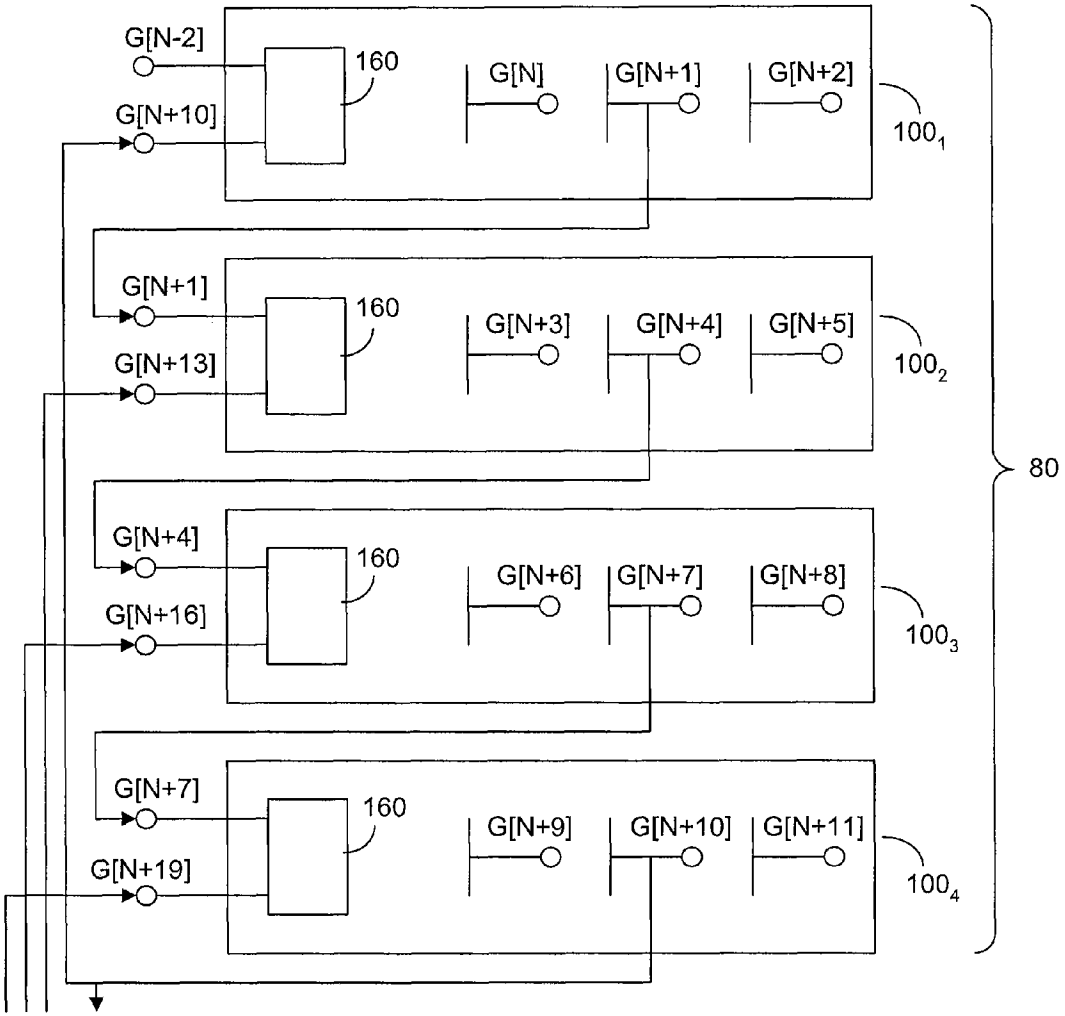

FIGS. 18*a*-18*c* show the connections between gate-driver states in various gate-driver circuits and choices in the trigger pulse. FIGS. 18*a* and 18*b* show the gate-driver group as shown in FIG. 12, where P=6, Q=3 , and R=2. In FIG. 18*a*, G[N−2] is used as the trigger pulse to the first stage $100_1$. As such, the pre-charged period of the Boost signal level is 2 H. In FIG. 18*b*, G[N−1] is used as the trigger pulse and the pre-charged period of the Boost signal level is 1 H. FIGS. 18*c* and 18*d* show the gate-driver group as shown in FIG. 6, where P=12, Q=4 and R=3. In FIG. 18*c*, G[N−3] is used as the trigger pulse to the first stage $100_1$. As such, the pre-charged period of the Boost signal level is 3 H. In FIG. 18*d*, G[N−2] is used as the trigger pulse and the pre-charged period of the Boost signal level is 2 H. It is also possible to use G[N−1] as the trigger pulse to the first stage $100_1$.

Figure 19:
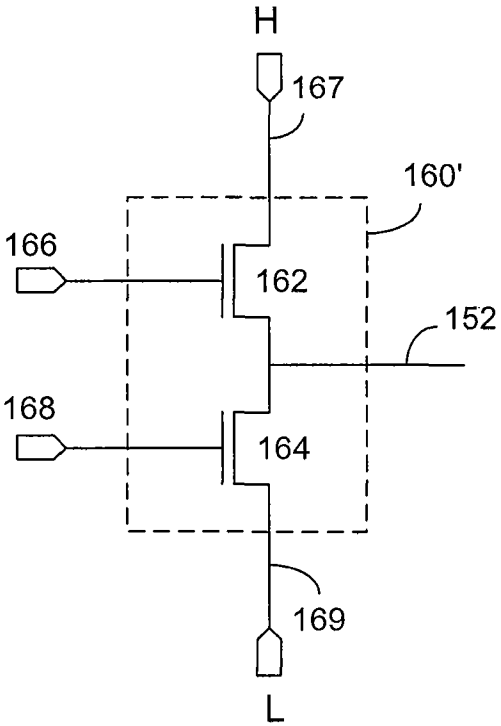
FIG. 19 shows a different input unit in the main driver.

FIG. 19 shows a different input unit in the main driver. As shown in FIG. 16, the input unit 160 has two inputs 166 and 168 to receive two gate signals for controlling the switching units 162, 164. One of the source/drain terminals of the switching unit 162 is also connected to the input 166, and one of the source/drain terminals of the switching unit 164 is connected to Vss. In FIG. 19, the input unit 160' also has two inputs 166 and 168 to receive two gate signals for controlling the switching units 162, 164. One of the source/drain terminals of the switching unit 162 is now connected to a reference voltage level H, and one of the source/drain terminals of the switching unit 164 is connected to another reference voltage level L. The input unit 160' is used in the drive circuits as shown in FIGS. 20 and 22.

Figure 20:
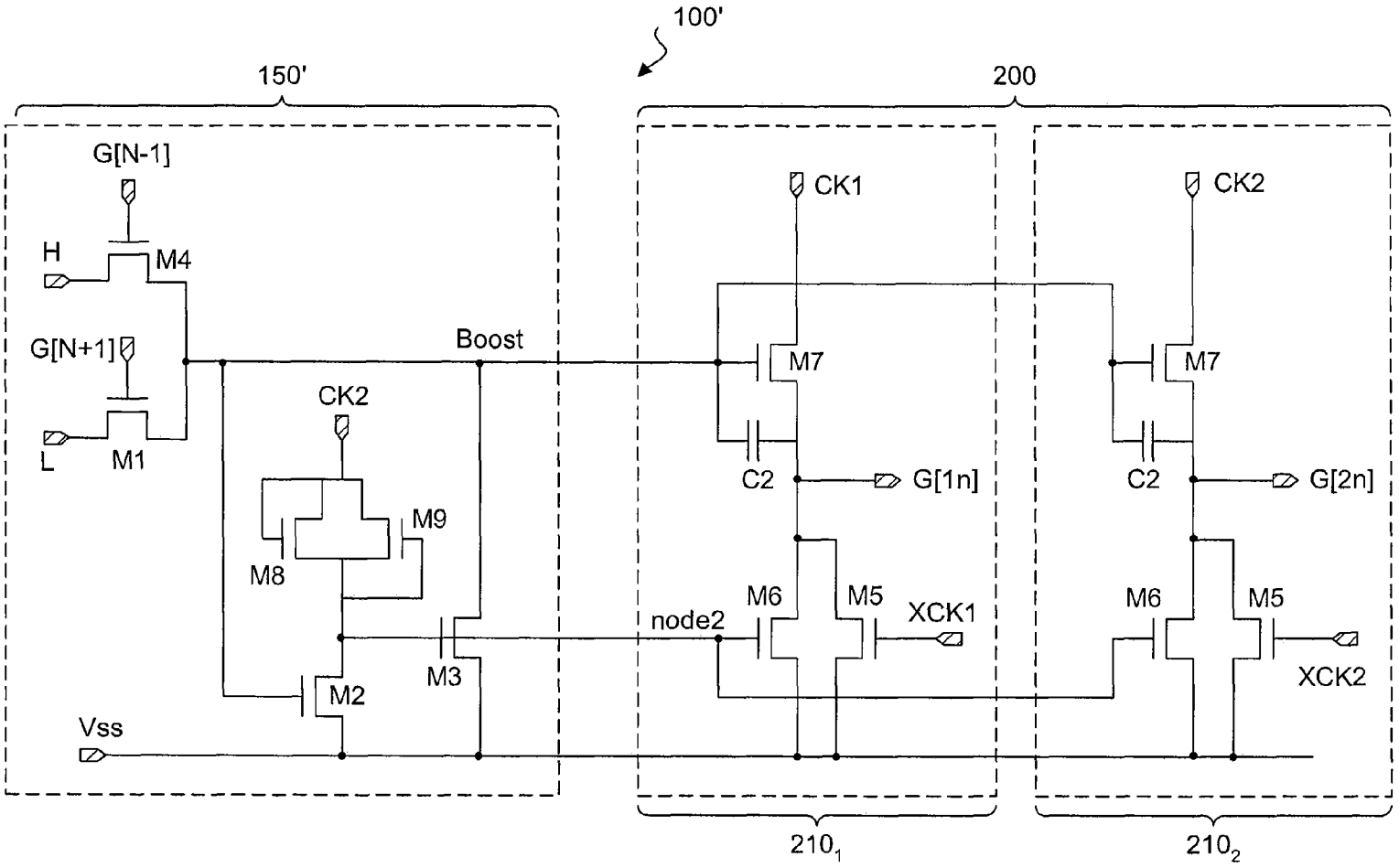
FIG. 20 shows a gate-driver circuit according to a different embodiment of the present invention.

FIG. 20 shows a gate-driver circuit according to a different embodiment of the present invention. In the embodiment as shown in FIG. 20, the driver stage 100' can be considered as the only stage in the driver group. Since there are only two gate lines G1*n*, G2*n* in each group, we have P=2, Q=1, R=2. The pulse-width of clock signals ck1 and ck2 is 1 H and time-shift between ck1 and ck2 is H/2. The drive stage 100' has a main driver 150' and a multi-output circuit 200 comprising a sub-output circuit $210_1$ to output a gate signal $G_{1n}$ and a sub-output circuit $210_2$ to output a gate signal $G_{2n}$. The gate signals $G_{1n}$ and $G_{2n}$ are provided in sync with ck1 and ck2 and, therefore, the gate signals $G_{1n}$ and $G_{2n}$ overlap by H/2. The main driver 150' has an input $G_{n-1}$ to receive a trigger pulse in order to allow the switching unit M4 to start charging the Boost signal level. The main driver 150' has an input $G_{n-2}$ to receive a gate signal in order to allow the switching unit M1 to discharge the Boost signal. Either the gate signal $G_{1n}$ or the gate signal $G_{2n}$ in the driver stage 100' can be used as a trigger pulse to the following driver stage.

Figure 21A:
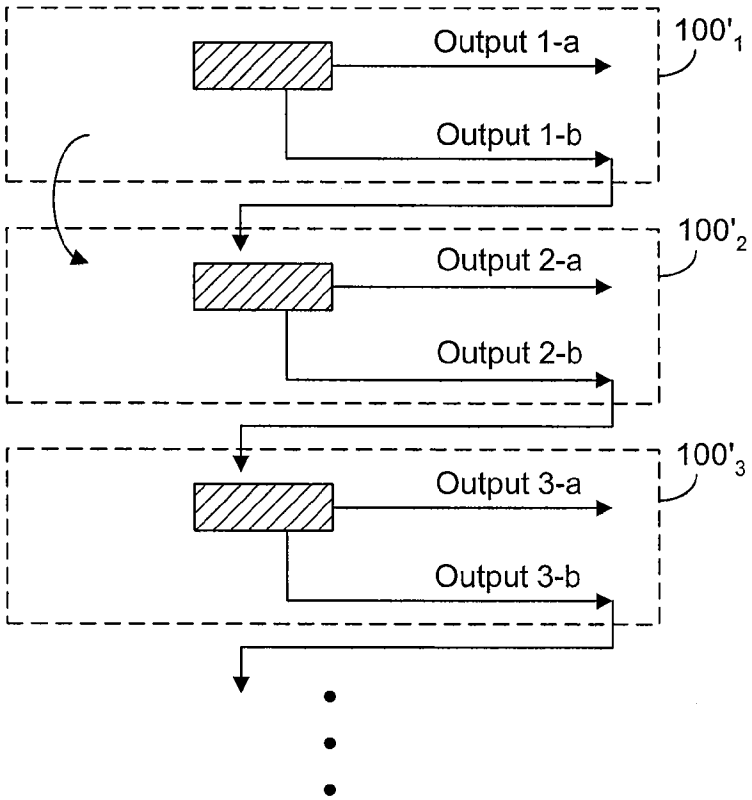
FIGS. 21*a* and 21*b* show the connection between a series of gate drivers as shown in FIG. 20.
Figure 21B:
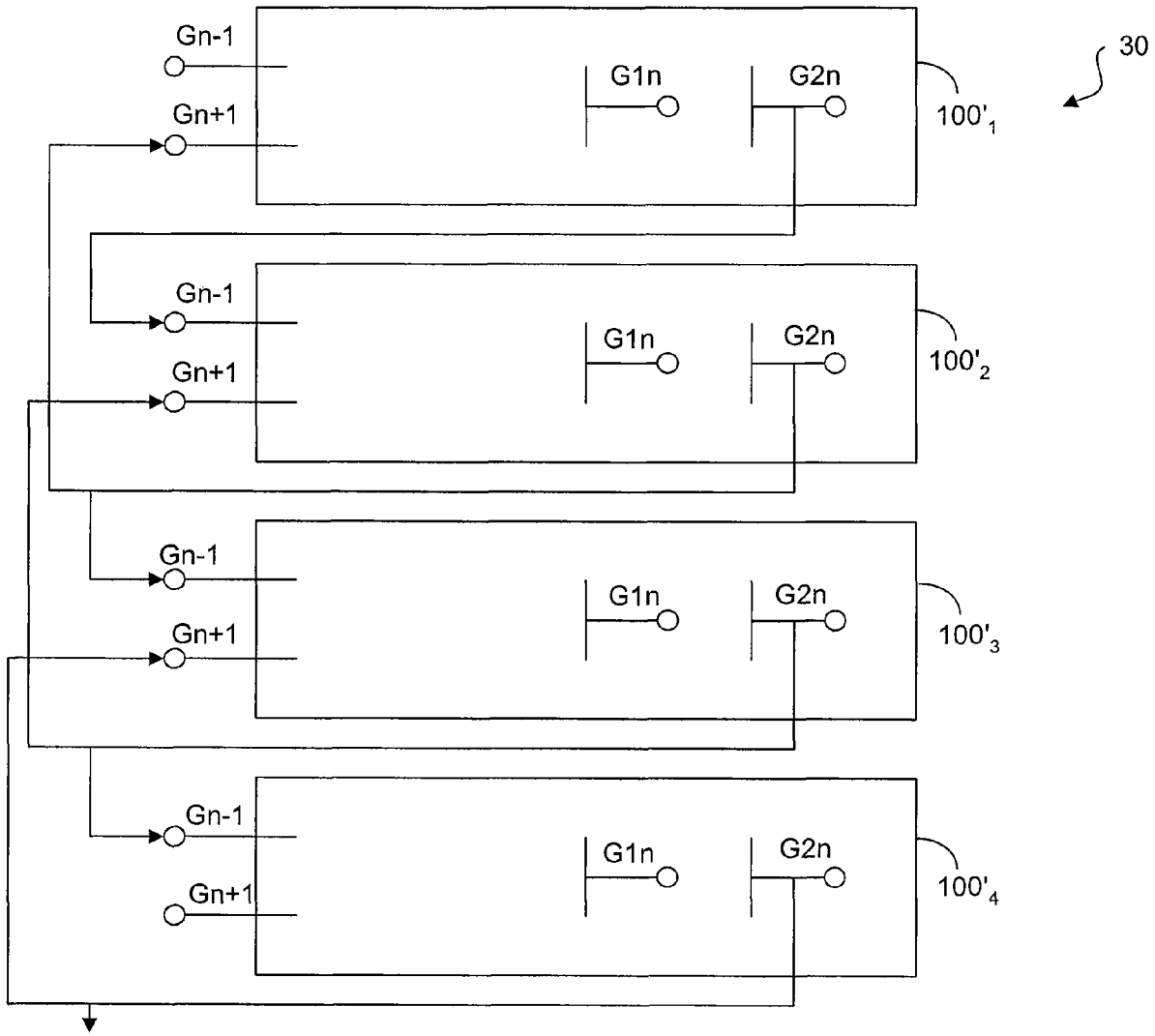

FIGS. 21*a* and 21*b* show the connection between a series of gate-driver stages as shown in FIG. 20. As shown in FIG. 21*a*, the trigger pulse from the driver stage $100'_1$ to the next drive stage $100'_2$ is Output1-*b*. Either $G_{1n}$ or $G_{2n}$ of the driver stage $100'_1$ can be used as a trigger pulse to the input $G_{n-1}$ of the driver stage $100'_2$ and the difference is the pre-charging period of Boost signal being 1 H or H/2. The overlapping period of $G_{2n}$ in one driver stage and $G_{1n}$ in the following stage is H/2. FIG. 21*b* shows that the gate signal $G_{2n}$ of a driver stage is used as a trigger pulse to the next driver stage.

Figure 22:
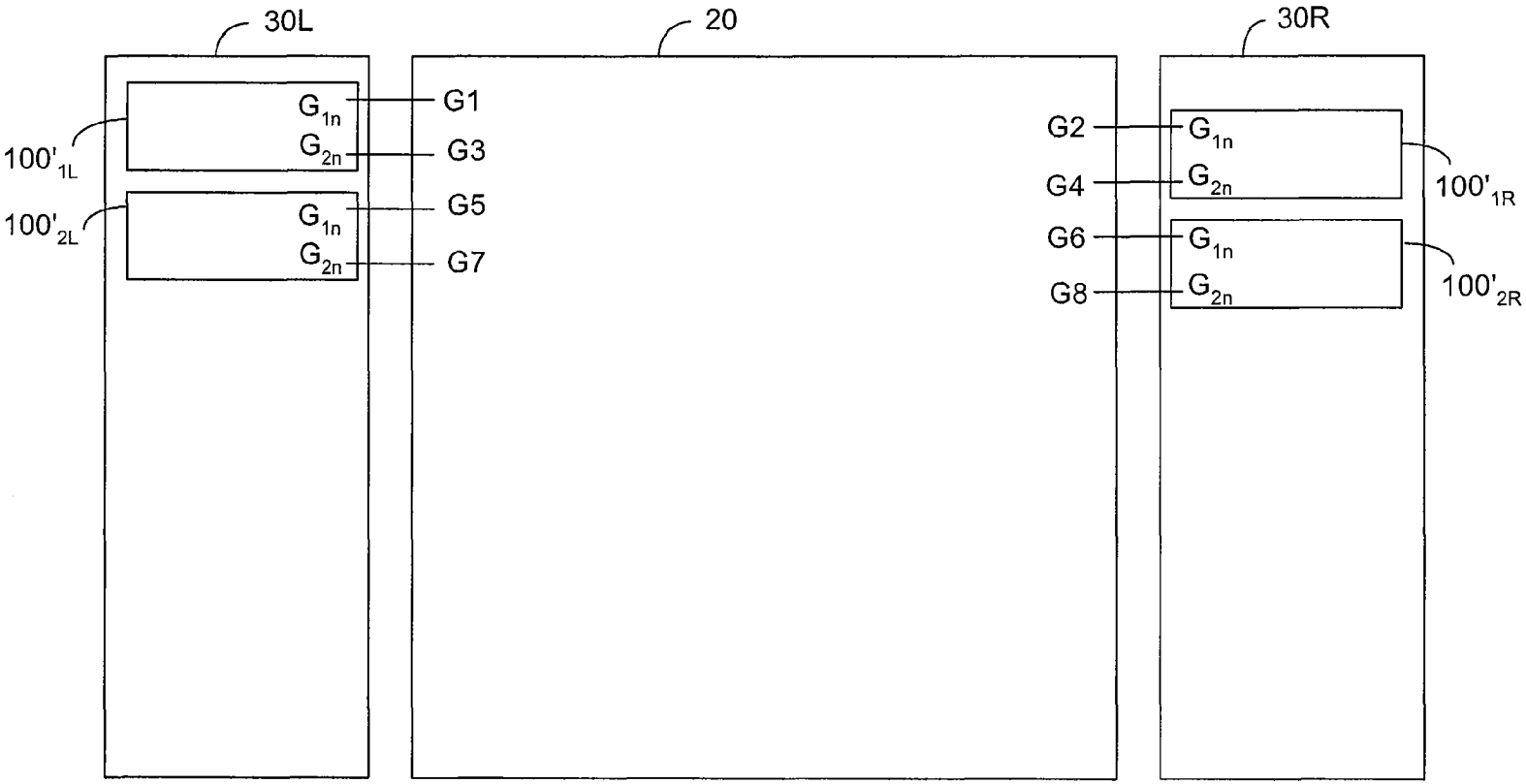
FIG. 22 shows how two gate-driver circuits for providing gate line signals to a display area, according to one embodiment of the present invention.
Figure 23:
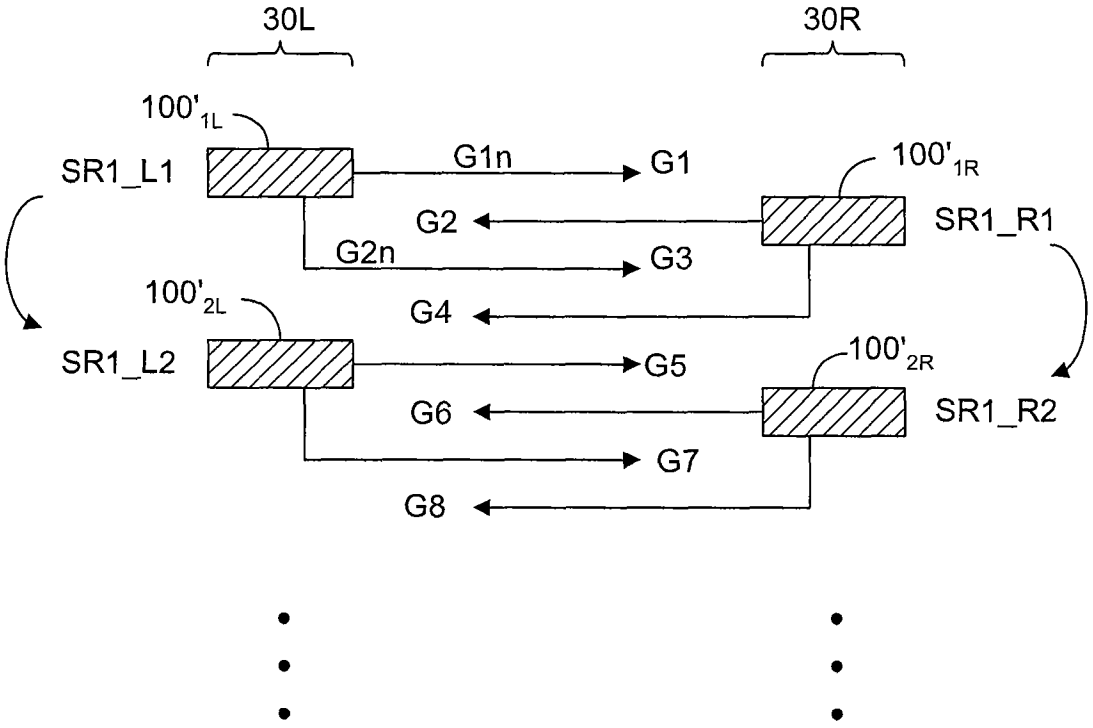
FIG. 23 shows how the gate-driver stages in the two gate-driver circuits are arranged to provide gate-line signals.

It is possible to arrange the gate driver stages in a different fashion as shown in FIG. 22. Instead of arranging one gate driver circuit 30 on one side of the display area 20 as shown in FIG. 2, one gate driver circuit 30L is located on the left side of the display area 20 and another gate driver circuit 30L is located on the right side of the display area 20. Each of the gate driver circuits 30L, 30R can be similar to the gate driver circuit 30 as shown in FIG. 21*b*. In the embodiment as shown in FIG. 22, the gate-driver stages $100'_{1L}$, $100'_{2L}$, . . . , are used to provide the gate signals to gate lines G1, G3, G5, . . . , whereas the gate-driver stages $100'_{1R}$, $100'_{2R}$, . . . , are used to provide the gate signals to gate lines G2, G4, G6, . . . The gate-driver arrangement as shown in FIG. 22 can be presented in a simpler way in FIG. 23. In FIG. 23, the arrow between SR1_L1 and SR1_L2 indicates that one of the gate signals in gate-driver $100'_{1L}$ (SR1_L1) is used as a trigger pulse to the next gate-driver $100'_{2L}$ (SR1_L2). The timing chart of FIG. 24 shows the four-phase arrangement in the gate-line driving arrangement as shown in FIG. 23.

Figure 27:
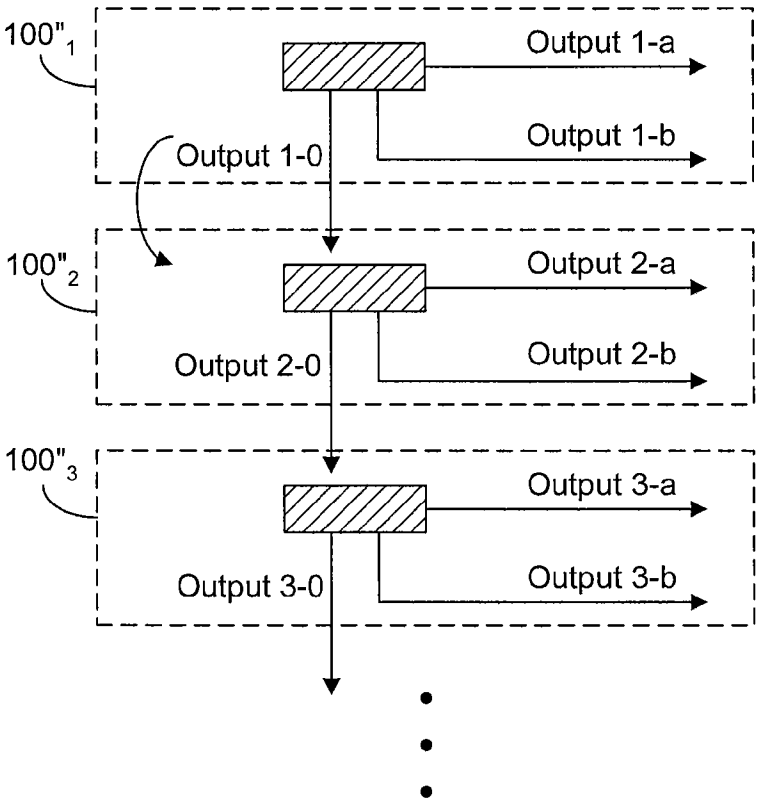
FIG. 27 shows the connection between a series of gate drivers as shown in FIG. 25.
Figure 25:
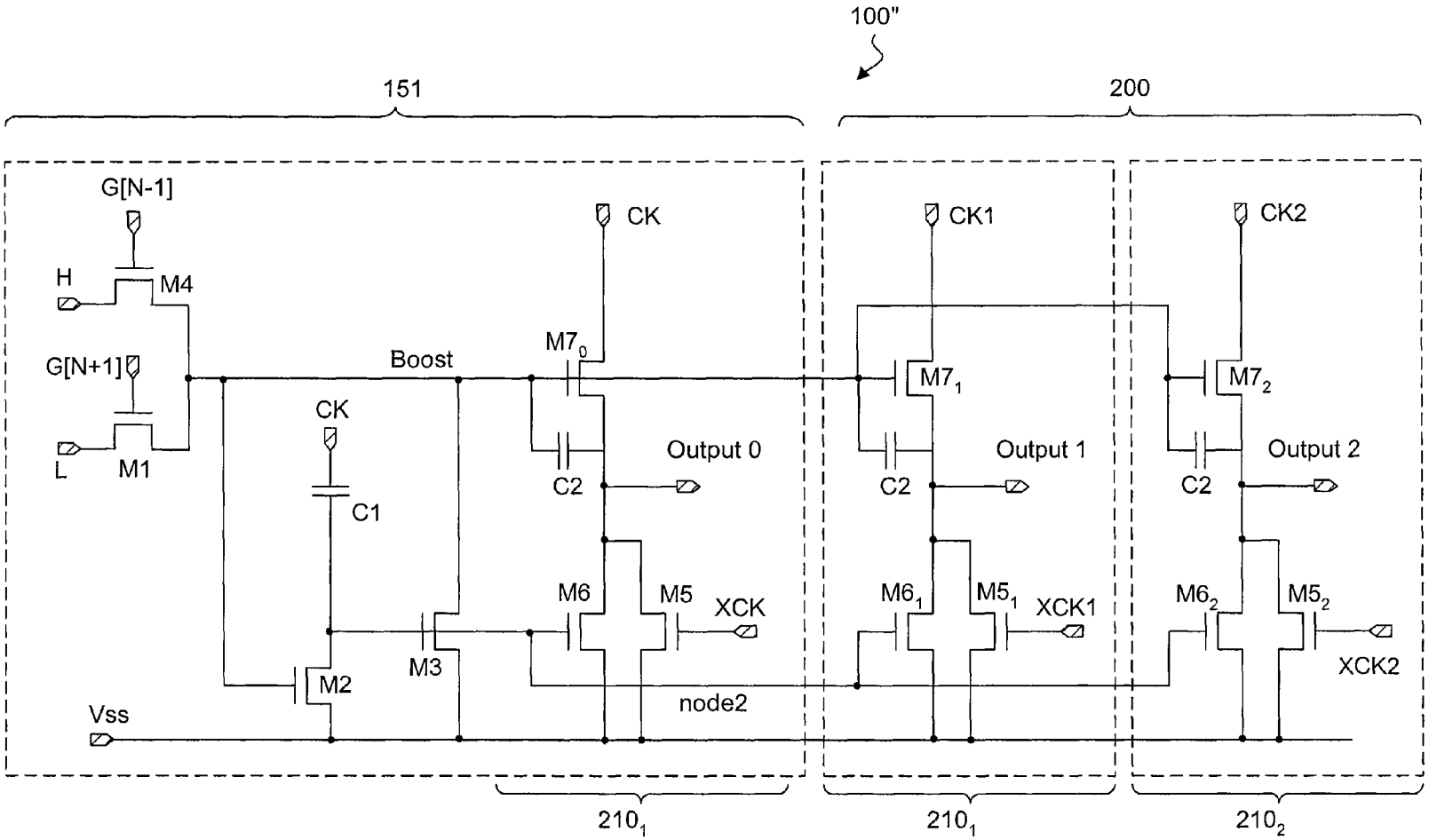
FIG. 25 shows a gate-driver circuit according to yet another embodiment of the present invention.
Figure 26:
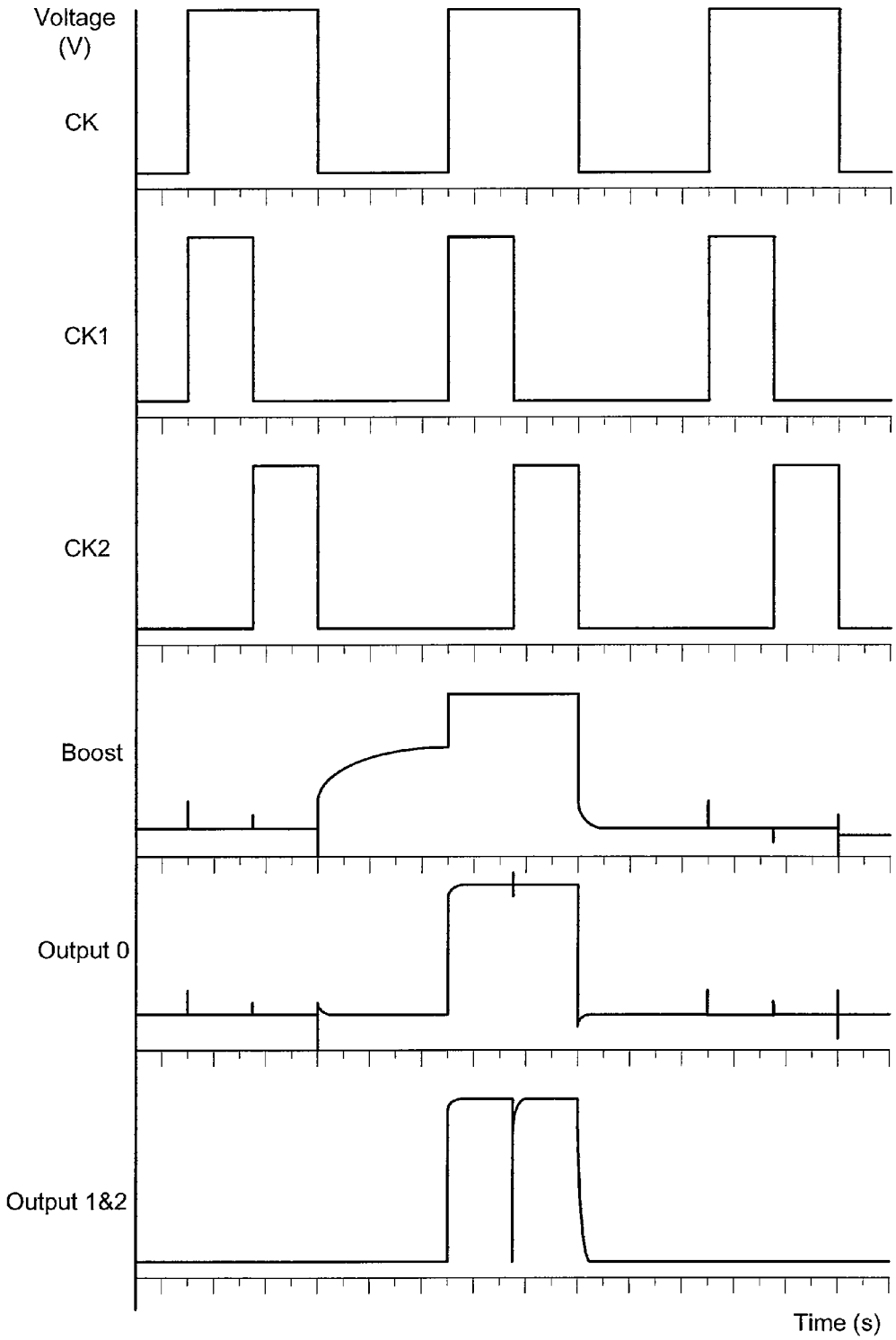
FIG. 26 is a timing chart showing the relationship between various signals.

FIG. 25 shows a gate-driver circuit according to yet another embodiment of the present invention. In the embodiment as shown in FIG. 25, one gate-driver stage 100" includes three sub-output circuits $210_0$, $210_1$, $210_2$. The sub-output circuits $210_1$, $210_2$ are part of the multi-output circuit 200 and their outputs Output1, Output2, are used to provide the gate signals. The sub-output circuit $210_0$ is part of the main driver 151 and the output Output0 is used as a trigger pulse to the next gate driver stage as shown in FIG. 26. In this embodiment, the pulse-width of the clock signal ck0 is greater than the pulse-width of each of the clock signals ck1 and ck2. Furthermore, the signal cycle of the clock signals ck1 and ck2 is the same as the signal cycle of the clock signal ck0. As shown in FIG. 26, the pulse-width of the clock signals ck1 and ck2 is equal to half the pulse-width of the clock signal ck0. The connection between the gate-driver stages is shown in FIG. 27, similar to the arrangement as shown in FIG. 21*a*.

Figure 28:
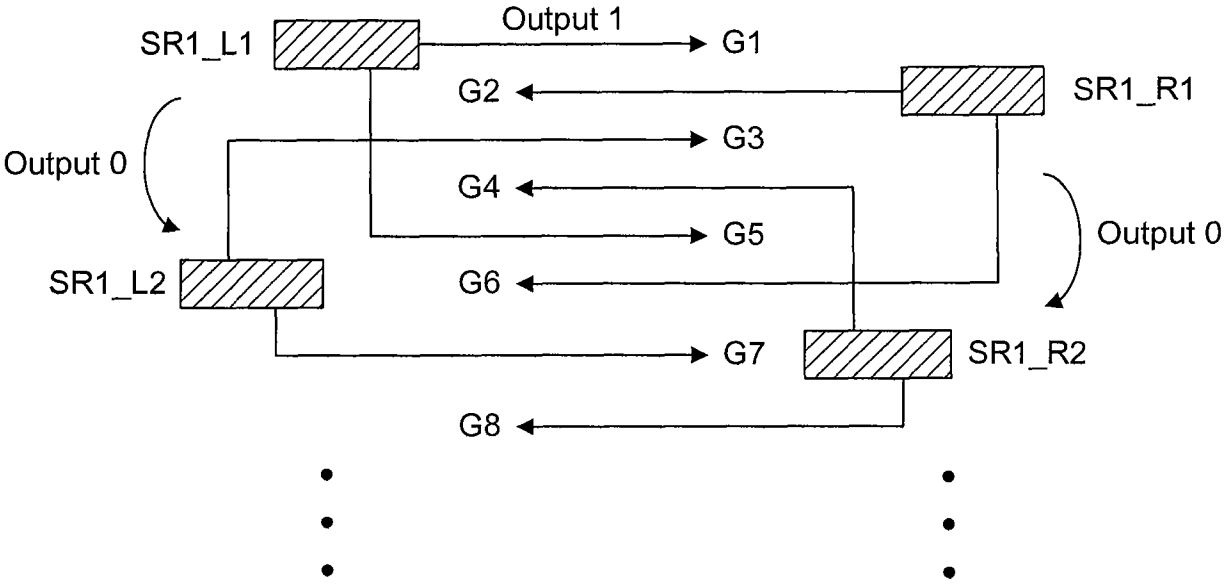
FIG. 28 shows how two gate-driver circuits for providing gate line signals to a display area, according to a different embodiment of the present invention.

It is possible to arrange the gate driver stages 100" in a different fashion, similar to the arrangement as shown in 23. As shown in FIG. 28, the gate-driver stages SR1_L1, SR1_L2, . . . are used to provide the gate signals to gate lines G1, G3, G5, . . . , whereas the gate-driver stages SR1_R1, SR1_R2, . . . , are used to provide the gate signals to gate lines G2, G4, G6, . . . and each of the gate-driver stages SR1_L1, SR1_L2, . . . , SR1_R1, SR1_R2, . . . can be similar to the gate-driver stage 100" as shown in FIG. 25. In FIG. 28, the arrow between SR1_L1 and SR1_L2 indicates that Output0 in the main driver 151 of SR1_L1 is used as a trigger pulse to the next gate-driver SR1_L2. The arrow between SR1_R1 and SR1_R2 indicates that Output0 in the main driver 151 of SR1_R1 is used as a trigger pulse to the next gate-driver SR1_R2 (see FIG. 25).

Figure 24:
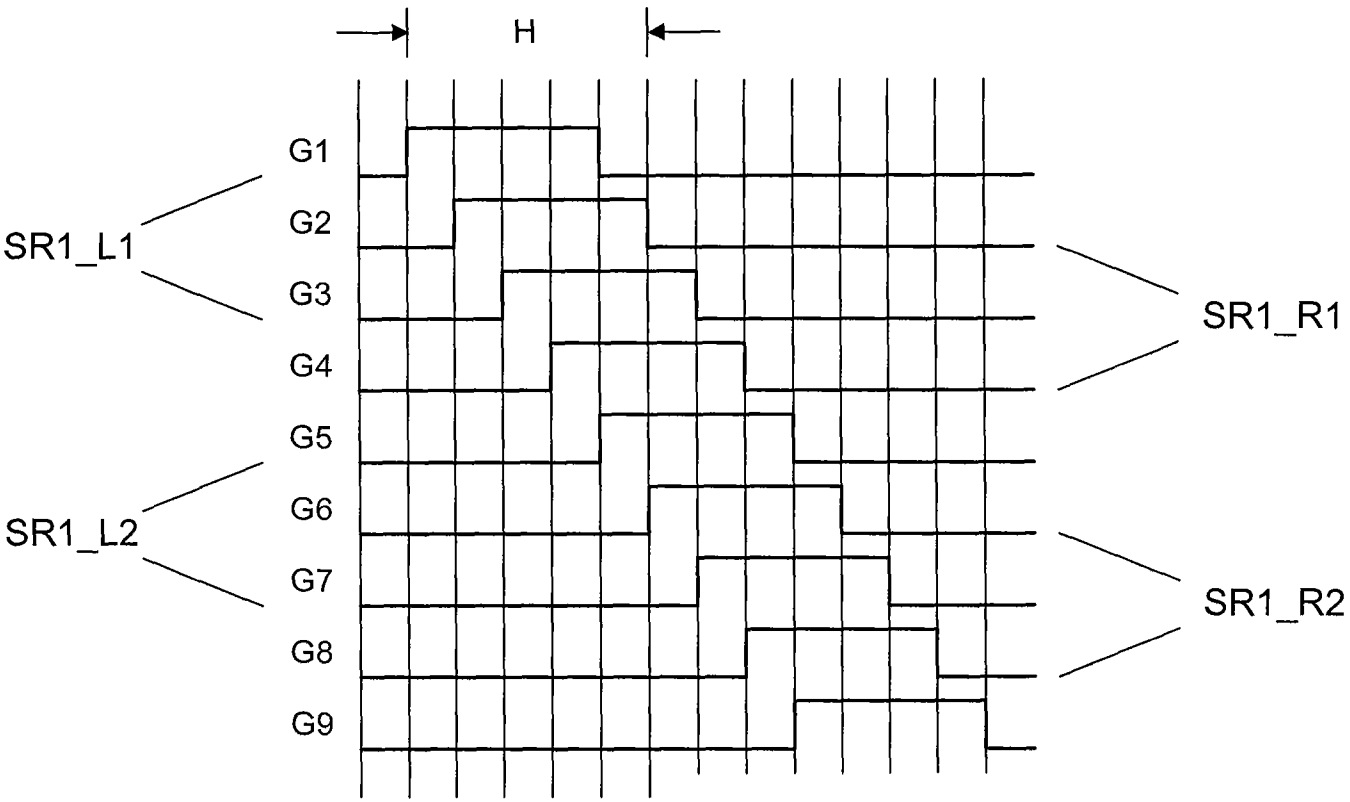
FIG. 24 is a timing chart showing the gate-lines as provided by the gate-driver stages.

The timing chart for four-phase arrangement in the gate-line driving arrangement as shown in FIG. 28 is similar to the timing chart as shown in FIG. 24.

The present invention, as disclosed in various embodiments, uses few switching elements in the gate-driver. In particular, the gate driver is so integrated in a display panel as a gate-driver-on-array structure. Using fewer switching elements in the gate driver can reduce the periphery area of the display panel. Thus, the present invention provides a gate-driver circuit, which comprises a main driver configured to provide a charging signal in response to a trigger pulse, and an output section comprising a plurality of output circuits arranged to receive the charging signal, wherein each of said plurality of output circuits is configured to provide an output signal in response to the charging signal and a clock signal. Each of the plurality of output circuits comprises a switching element operable in a conducting state in response to the charging signal, the switching element comprises an input end to receive the clock signal and an output end to provide the output signal when the switching element is operated in the conducting state.

According to one embodiment of the present invention, each of the output circuits further comprises a discharging unit electrically connected to the output end of the switching element, the discharging unit arranged to receive an input signal complementary to the clock signal for resetting the output signal and the main driver is further configured to receive a second pulse subsequent to the trigger pulse for resetting the charging signal.

The present invention also provides a gate-driver comprising a plurality of gate-driver stages, each of the gate-driver stages comprising a main driver configured to provide a charging signal in response to a trigger pulse, and an output section comprising a plurality of output circuits arranged to receive the charging signal, wherein each of said plurality of output circuits is configured to provide an output signal in response to the charging signal and a clock signal.

In one embodiment of the present invention, the output circuits comprises N output circuits arranged to receive N sequential clock signals for providing N sequential output signals, N being a positive integer greater than 1, wherein said N clock signals comprises a first clock pulse and a second clock pulse immediately subsequent to the first clock pulse and wherein the first clock pulse and the second clock pulse are shifted by one time unit, and wherein the first clock pulse is subsequent to the trigger pulse such that the trigger pulse and the first clock pulse are shifted by at least one time unit. In another embodiment of the present invention, the output circuits comprises N output circuits arranged to receive N sequential clock signals for providing N sequential output signals, N being a positive integer greater than 1, wherein said N clock signals comprises a first clock pulse and a last clock pulse subsequent to the first clock pulse and wherein the first clock pulse and the last clock pulse are shifted by (N−1) time units.

In one embodiment of the present invention the gate-driver stages comprises Q stages, Q being a positive integer greater than 1, each of the Q stages arranged to provide N sequential output signals, said N sequential output signals comprising a first output signal and a last output signal subsequent to the first output signal, wherein said Q stages comprises a first stage and a last stage, said Q stages arranged in a cascade fashion such that the first output signal of the first stage and the last output signal of the last stage are shifted by (Q×N−1) time units. In another embodiment of the present invention, the gate-driver stages comprises Q stages, Q being a positive integer greater than 1, each of the Q stages arranged to provide N sequential output signals, said N sequential output signals comprising a first output signal and a last output signal subsequent to the first output signal, wherein said Q stages comprises a first stage and a second stage, said Q stages arranged in a cascade fashion such that the first output signal of the first stage and the first output signal of the second stage are shifted by N time units, and wherein one of said N sequential output signals from the first stage is arranged to provide the trigger pulse to the main driver in the second stage. In yet another embodiment of the present invention, the main driver further comprises a main output circuit arranged to provide a main output signal in response to the charging signal a different clock signal wherein said plurality of gate-driver stages comprises Q stages, Q being a positive integer greater than 1, each of the Q stages arranged to provide N sequential output signals, wherein said Q stages comprises a first stage and a second stage, said Q stages arranged in a cascade fashion such that the first output signal of the first stage and the first output signal of the second stage are shifted by N time units, and wherein the main output signal from the first stage is arranged to provide the trigger pulse to the main driver in the second stage.

The present invention also provides a display panel, such as a liquid-crystal display panel, which comprises a display area comprising a thin-film transistor array, the transistor array configured to receive gate lines signals in a plurality of gate lines for controlling an array of pixels; and a gate line driver configured to provide the gate line signals to the thin-film transistor array, the gate line driver comprising a plurality of gate-driver stages, each of the gate-driver stages comprising a main driver and an output section as described earlier. In one embodiment of the present invention, the display area is arranged on a first section of a substrate, and the gate line driver is located on a second section of the substrate adjacent to the first section. In other embodiment of the present invention, the display area is arranged on a first section of a substrate, the display area comprising a first side and a different second side, and said plurality of gate-drivers stages comprises a first group of gate-driver stages located in a second section of the substrate adjacent to the first side of the display area and a second group of gate-driver stages located in a third section of the substrate adjacent to the second side of the display area, and wherein said plurality of gate lines comprises a first group of gate lines configured to receive gate line signals from the first group of gate-driver stages and a second group of gate lines configured to receive gate line signals from the second group of gate-driver stages.

Accordingly, the method for driving the display panel, according to the present invention, comprises: providing a gate line driver to generate the gate line signals for driving the thin-film transistor array, wherein the gate line driver comprises a plurality of gate-driver stages, each of the gate-driver stages comprising a main driver and an output section comprising a plurality of output circuits; providing a trigger pulse to the main driver for generating a charging signal in response to the trigger signal; providing a plurality of sequential clock signals to the output section; providing the charging signal and a different one of the sequential clock signals to each of said plurality of output circuits for generating one of the gate line signals, wherein the plurality of sequential clock signals are arranged such that they are overlapping in time with one another.

In one embodiment of the present invention, the method further comprises:

arranging the gate line driver into Q gate-driver stages, each of the Q stages configured to provide N sequential output signals, said N sequential output signals comprising a first output signal and a last output signal subsequent to the first output signal, wherein said Q stages comprises a first stage and a last stage, said Q stages arranged in a cascade fashion such that the first output signal of the first stage and the last output signal of the last stage are shifted by (Q×N−1) time units, wherein Q and N are positive integers greater than 1.

In another embodiment of the present invention, the method further comprises:

arranging the gate line driver into Q gate-driver stages, each of the Q stages arranged to provide N sequential output signals, said N sequential output signals comprising a first output signal and a last output signal subsequent to the first output signal, wherein said Q stages comprises a first stage and a second stage, said Q stages arranged in a cascade fashion such that the first output signal of the first stage and the first output signal of the second stage are shifted by N time units, and wherein one of said N sequential output signals from the first stage is arranged to provide the trigger pulse to the main driver in the second stage, wherein Q and N are positive integers greater than 1.

In a different embodiment, the method further comprises:

arranging the gate line driver into a plurality of gate-line groups, each group comprising P gate-lines, and said plurality of gate-driver stages comprises Q gate-driver stages for providing said P gate lines, and each of said Q gate-driver stages comprises R of said plurality of output circuits arranged to receive R sequential clock signals for providing R sequential output signals, P, Q and R being positive integers greater than 1, wherein said R clock signals comprises a first clock pulse and a second clock pulse immediately subsequent to the first clock pulse and wherein the first clock pulse and the second clock pulse are shifted by a time unit, and wherein the main driver is further configured to receive a reset pulse subsequent to the trigger pulse for resetting the charging signal, and wherein the trigger pulse and the reset pulse are shifted by P time units.

Furthermore, the first clock pulse is subsequent to the trigger pulse such that the trigger pulse and the first clock pulse are shifted by a time period determined by [(P/2)−R+1], wherein when [(P/2)−R+1] is equal to 1, the time period is equal to one time period, and when [(P/2)−R+1] is greater than 1, the time period is equal to M time period, with M being a positive integer from 1 up to [(P/2)−R+1].

In various embodiments of the present invention, the plurality of sequential clock signals comprise N sequential clock signals and said plurality of output circuits comprises N output circuits arranged to receive the N sequential clock signals for providing N sequential output signals, wherein said N clock signals comprises a first clock pulse and a second clock pulse immediately subsequent to the first clock pulse and wherein the first clock pulse and the second clock pulse are shifted by one time unit, and wherein the first clock pulse is subsequent to the trigger pulse such that the trigger pulse and the first clock pulse are shifted by at least one time unit, wherein N is a positive integer greater than 1.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A circuit, comprising:

a main driver configured to provide a charging signal in response to a trigger pulse; and an output section comprising a plurality of output circuits arranged to receive the charging signal, wherein each of said plurality of output circuits is configured to provide an output signal in response to the charging signal and a different clock signal, said plurality of output circuits comprising a first output circuit and a second output circuit, wherein the output signal provided in the first output circuit is in response to the charging signal and a first clock signal, and the output signal provided in the second output circuit is in response to the charging signal and a second clock signal subsequent to the first clock signal, wherein the main driver comprises:

a first switching element comprising an output end and a controlling end, the controlling end arranged to receive the trigger pulse and the output end arranged to provide the charging signal, the first switching element operable in a conducting state in response to the trigger pulse;

a second switching element comprising a first end electrically connected to the output end of the first switching element, a second end connected to a voltage source, and a controlling end arranged to receive a second pulse subsequent to the trigger pulse for resetting the charging signal, wherein the second switching element is operable in a conducting state in response to the second pulse so as to electrically connect the output end of the first switching element to the voltage source;

a third switching element comprising a first end, a second end connected to the voltage source, and a controlling end connected to the output end of the first switching element, wherein the first end is arranged to receive the first clock signal and wherein the third switching element is operable in a conducting state in response to the charging signal; and a fourth switching element comprising a first end connected to the output end of the first switching element, a second end connected to the voltage source, and a controlling end arranged to receive the first clock signal.

2. The circuit according to claim 1, wherein each of said plurality of output circuits comprises:

a first switching circuit comprising an input end, an output end and a controlling end, the first switching circuit operable in a conducting state in response to the charging signal received in the controlling end, wherein the input end is arranged to receive the different clock signal and the output end is arranged to provide the output signal when the first switching circuit is operated in the conducting state.

3. The circuit according to claim 2, wherein the main driver is further configured to provide a resetting signal in response to the second pulse, and wherein each of said plurality of output circuits further comprises:

a second switching circuit comprising a first end, a second end and a controlling end, wherein the first end of the second switching circuit is electrically connected to the output end of the first switching circuit, the second end of the second switching circuit is electrically connected to a voltage source, and wherein the second switching circuit is operable in a conducting state in response to the resetting signal received in the controlling end of the second switching circuit so as to effectively connect the output end of the first switching circuit to the voltage source.

4. The circuit according to claim 3, wherein each of said plurality of output circuits further comprises:

a third switching circuit comprising a first end, a second end and a controlling end, wherein the first end of the third switching circuit is electrically connected to the output end of the first switching circuit, the second end of the third switching circuit is electrically connected to the voltage source, and wherein the third switching element is operable in a conducting state in response to an input signal in the controlling end of the third switching circuit, wherein the input signal is complementary to the different clock signal.

5. The circuit according to claim 1, wherein the first clock signal and the second clock signal are partially overlapping in time.

6. A gate driver, comprising:

a plurality of gate-driver stages, each of the gate-driver stages comprising:

a main driver configured to provide a charging signal in response to a trigger pulse, wherein the trigger pulse has a first pulse edge and a subsequent second pulse edge, and the charging signal comprises a first signal edge substantially in synchronization with the first pulse edge, and an output section comprising a plurality of output circuits arranged to receive the charging signal and a different clock signal, said plurality of output circuits comprising at least a first output circuit and a second output circuit the first output circuit arranged to provide a first output signal in response to the charging signal and a first clock signal, the second output circuit arranged to provide a second output signal in response to the charging signal and a second clock signal subsequent to the first clock signal, wherein the first clock signal and the second clock signal are partially overlapping in time, wherein the output signal provided in the first output circuit is in response to the charging signal and a first clock signal, and the output signal provided in the second output circuit is in response to the charging signal and a second clock signal subsequent to the first clock signal, wherein the main driver comprises:

a first switching element comprising an output end and a controlling end, the controlling end arranged to receive the trigger pulse and the output end arranged to provide the charging signal, the first switching element operable in a conducting state in response to the trigger pulse;

a second switching element comprising a first end electrically connected to the output end of the first switching element, a second end connected to a voltage source, and a controlling end arranged to receive a second pulse subsequent to the trigger pulse for resetting the charging signal, wherein the second switching element is operable in a conducting state in response to the second pulse so as to electrically connect the output end of the first switching element to the voltage source;

a third switching element comprising a first end, a second end connected to the voltage source, and a controlling end connected to the output end of the first switching element, wherein the first end is arranged to receive the first clock signal and wherein the third switching element is operable in a conducting state in response to the charging signal; and a fourth switching element comprising a first end connected to the output end of the first switching element, a second end connected to the voltage source, and a controlling end arranged to receive the first clock signal.

7. The gate driver according to claim 6, wherein the main driver is further configured to provide a resetting signal in response to the second pulse, wherein each of said plurality of output circuits comprises:

a first switching circuit comprising an input end, an output end and a controlling end, the first switching circuit operable in a conducting state in response to the charging signal received in the controlling end, wherein the input end is arranged to receive the different clock signal and the output end is arranged to provide the output signal when the first switching circuit is operated in the conducting state;

a second switching circuit comprising a first end, a second end and a controlling end, wherein the first end of the second switching circuit is electrically connected to the output end of the first switching circuit, and the second end of the second switching circuit is electrically connected to a voltage source, and wherein the second switching circuit is operable in a conducting state in response to the resetting signal received in the controlling end of the second switching circuit so as to effectively connect the output end of the first switching circuit (M7) to the voltage source; and a third switching circuit comprising a first end, a second end and a controlling end, wherein the first end of the third switching circuit is electrically connected to the output end of the first switching circuit, and the second end of the third switching circuit is electrically connected to the voltage source, and wherein the third switching element is operable in a conducting state in response to an input signal in the controlling end of the third switching circuit, wherein the input signal is complementary to the different clock signal.

* * * * *